US009202395B2

(12) United States Patent
Cho et al.

(10) Patent No.: US 9,202,395 B2
(45) Date of Patent: Dec. 1, 2015

(54) CURVED FRAME AND CURVED DISPLAY DEVICE HAVING THE SAME

(75) Inventors: Joo-Woan Cho, Asan-si (KR); Yoon-Soo Kwon, Hwaseong-si (KR)

(73) Assignee: Samsung Display Co., Ltd. (KR)

( * ) Notice: Subject to any disclaimer, the term of this patent is extended or adjusted under 35 U.S.C. 154(b) by 415 days.

(21) Appl. No.: 13/614,506

(22) Filed: Sep. 13, 2012

(65) Prior Publication Data

US 2014/0009914 A1 Jan. 9, 2014

(30) Foreign Application Priority Data

Jul. 9, 2012 (KR) ..... 10-2012-0074628

(51) Int. Cl.

| | |
|---|---|
| ***F21V 7/04*** | (2006.01) |
| ***G09F 9/35*** | (2006.01) |
| ***G09F 9/30*** | (2006.01) |

(52) U.S. Cl.

CPC .. *G09F 9/35* (2013.01); *G09F 9/30* (2013.01); *G09F 9/301* (2013.01)

(58) Field of Classification Search

CPC ..... G02F 1/133608
USPC ..... 362/632–634, 97.1–97.3; 349/58
See application file for complete search history.

(56) References Cited

U.S. PATENT DOCUMENTS

| | | | | |
|---|---|---|---|---|
| 7,920,223 | B2 | 4/2011 | Nishizawa et al. | |
| 2009/0091681 | A1 | 4/2009 | Nishizawa et al. | |
| 2010/0171900 | A1* | 7/2010 | Lee | 349/58 |

FOREIGN PATENT DOCUMENTS

| | | | |
|---|---|---|---|
| JP | 2010-039441 | A | 2/2010 |
| KR | 1020070057308 | A | 6/2007 |

* cited by examiner

*Primary Examiner* — Sean Gramling
(74) *Attorney, Agent, or Firm* — Innovation Counsel LLP

(57) ABSTRACT

A curved frame is provided for securing therein a display panel and an optionally curved backlight unit. The curved frame includes an upper frame part, a lower frame part, a left frame part and a right frame part. The upper frame part has a first set of curved guide rails formed thereon, which guide rails are bent in accordance with first curvatures of upper sides of the display panel and the backlight unit. The lower frame part has a second set of guide rails formed thereon, which guide rails are bent in accordance with second curvatures of lower sides of the display panel and the backlight unit. The left frame part is combined with each of first edge portions of the upper and lower frame parts. The right frame part is combined with each of second edge portions of the upper and lower frame parts.

23 Claims, 15 Drawing Sheets

CURVED FRAME AND CURVED DISPLAY DEVICE HAVING THE SAME

CROSS-REFERENCE TO RELATED APPLICATIONS

This application claims priority under 35 U.S.C. §119 to Korean Patent Application No. 10-2012-0074628, filed on Jul. 9, 2012 in the Korean Intellectual Property Office (KIPO), the contents of which application are herein incorporated by reference in their entirety.

BACKGROUND

1. Technical Field

The present disclosure of invention relates to a curved frame and a curved display device having the curved frame. More particularly, the present disclosure of invention relates to a curved frame for defining and/or securing a predetermined curvature for an image display panel (one having an image driving, backlighting portion) and to a curved display device having the curved frame.

2. Discussion of Related Technology

In recent years, as thin panel display devices such as liquid crystal display (LCD) devices have come to be more commonly used as display devices of television receivers, home movie theaters, computers (e.g., those used for high definition gaming) and so on, the screens of flat panel versions of such thin panel display devices (e.g., LCD devices) are tending to become increasingly bigger. But one problem with increasingly larger and flat panel LCD or other such thin profile screens is that the viewing angle differences between the state where the viewer is focusing on the center portion of the screen (wherein the normal to the screen surface and the viewer's line of sight (LOS) are basically coincident) and where the viewer is focusing on the left and/or right far edges of the flat screen (wherein the normal to the screen surface and the viewer's LOS are substantially not coincident) increases.

In this specification, the technical term "viewing angle" is defined as the angle present between the line of sight (LOS) of the viewer focusing on a particular surface region of the screen and the surface tangent plane present at the intersection of the line of sight and the focused upon surface region. The difference between the central and the extreme left or right edge viewing angles is defined as and used to mean the "viewing angle difference" (VADmax).

Another problem with large-scale flat panel television screens and the like is that glare off the screens from ambient light sources (e.g., room lamps) also tends to increase with increase of flat panel screen size.

The problems of difference in viewing angles and excessive glare can be corrected by curving the screen into a concave shape.

However, even when the viewing angle difference is improved (reduced) by a liquid-crystal panel with a concavely curved screen (referred to as "concavely curved liquid-crystal panel" below), the traditional approach is to use a flat panel backlighting unit with a same structure as that used for the conventional flat liquid-crystal panel. When this is done, there is a new problem, namely, that the uniformity of the light intensity that is emitted from the light source inside the flat panel backlighting unit is lost in particular at the peripheral edges of the concavely curved liquid-crystal panel. As a result, the image quality (e.g., brightness) of the concavely curved liquid-crystal panel at the left and right edges becomes lower than that of the screen of a conventional flat panel liquid-crystal display device.

One proposed countermeasure for solving this problem while using the flat panel style backlighting design is to enlarge the space between the backlighting light source and the curved screen so that difference in backlighting intensity is lessened. However, this causes the overall display device to become undesirably larger in volume occupied thereby. Such increase in overall volume tends to increase shipping, handling and packaging costs. It also tends to increase the weight of the device as shall become clearer from the below discussion.

It is to be understood that this background of the technology section is intended to provide useful background for understanding the here disclosed technology and as such, the technology background section may include ideas, concepts or recognitions that were not part of what was known or appreciated by those skilled in the pertinent art prior to corresponding invention dates of subject matter disclosed herein.

SUMMARY

The present disclosure of invention provides a curved frame having guide rails portions designed to appropriately define and/or secure the curvatures of a display panel (optionally a flexible display panel) and of a backlighting means (optionally a flexible backlighting means) and, in one embodiment, to keep the spacings between the two substantially uniform.

According to one aspect of the present disclosure of invention, a curved frame is provided to secure therein a display panel and an optionally curved backlight unit which is disposed behind the display panel. The curved frame includes an upper frame part, a lower frame part, a left frame part and a right frame part joined to one another. The upper frame part has a first guide rails portion formed thereon. The first guide rails portion is bent in accordance with a predetermined first set of curvatures to thereby secure and/or guide an upper side of the display panel and a corresponding upper side of the backlight unit. The lower frame part has a second guide rails portion formed thereon. The second guide rails portion is bent in accordance with a predetermined second set of curvature s to thereby secure and/or guide a lower side of the display panel and a lower side of the backlight unit. A left frame part is combined with a first edge portion of the upper frame part and a first edge portion of the lower frame part. A right frame part is combined with a second edge portion of the upper frame part and a second edge portion of the lower frame part.

In an exemplary embodiment, the first guide rails portion includes a first guide rail that extends substantially in parallel with a curved front surface of the upper frame part.

In an exemplary embodiment, the upper frame part and the lower frame part are bent according to a same set of predetermined curvatures.

In an exemplary embodiment, the upper frame part includes an upper mold piece and an upper chassis part joined with the upper mold piece. The upper mold has a chassis-receiving groove formed at an opposite side thereof relative to where the first guide rails portion is formed. The upper chassis part is disposed in the first groove of the upper mold and is made of a material that reinforces a strength of the upper mold piece.

In an exemplary embodiment, the upper mold may include an injection molding material, and the upper chassis may include a metal material.

In an exemplary embodiment, the lower frame part may include a lower mold piece and a lower chassis part joined with the lower mold piece. The lower mold has a second groove formed at an opposite to its second guide rails portion. The lower chassis is disposed in the second groove of the lower mold to reinforce a strength of the lower mold.

In an exemplary embodiment, the lower mold may include an injection molding material, and the lower chassis may include a metal material.

In an exemplary embodiment, the curved frame may further include a coupling part for inter-connecting the upper, lower and side frame parts. The coupling part may include a nut and a bolt. A nut inserting (receiving) groove for inserting the nut may be formed through one of the frame parts adjacent to each other. A bolt inserting (receiving) groove for inserting the bolt may be formed through the remaining frame part.

In an exemplary embodiment, the nut inserting groove may form a cross shape in combination with the bolt inserting (receiving) groove.

In an exemplary embodiment, the cross shape is configured to have a long groove portion and a short groove portion. The nut may be disposed in the short groove portion. The bolt is inserted through a first end portion of the long groove portion to penetrate through the nut and to extend into a second end portion of the long groove.

In an exemplary embodiment, a third guide rails portion may be formed through the left frame part, and a fourth guide rails portion may be formed through the right frame part.

According to another aspect of the present disclosure of invention, a curved display device includes a display panel, a backlight unit disposed at a rear surface of the display panel, and a curved frame securing the display panel and the backlight unit. The curved frame includes an upper frame part, a lower frame part, a left frame part and a right frame part. The upper frame part has a first guide rails portion formed thereon. The first guide rails portion is bent in accordance with a first predetermined set of curvatures to secure and/or guide an upper side of the display panel and an upper side of the backlight unit. The lower frame part has a second guide rails portion formed thereon. The second guide portion is bent in accordance with a second predetermined set of curvatures to secure and/or guide a lower side of the display panel and a lower side of the backlight unit. The left frame part is combined with a first edge portion of the upper frame part and a first edge portion of the lower frame part. The right frame part is combined with a second edge portion of the upper frame part and a second edge portion of the lower frame part.

In an exemplary embodiment, each of the first and second guide rails portions may include a first rail, a second rail and a third rail. The first rail may be formed adjacent to a front surface of corresponding frame part and configured to guide a first side of the display panel. The second rail may be formed behind the first rail and configured to guide a first side of an optical assembly of the backlight unit. The third rail may be formed behind the second rail and is configured to guide a first side of a light source assembly of the backlight unit.

In an exemplary embodiment, the backlight unit and the display panel may be spaced apart and disposed to have a uniform interval between them.

In an exemplary embodiment, the backlight unit may be a flat one.

In an exemplary embodiment, the upper frame part may include an upper mold and an upper chassis. The upper mold may have a first groove formed on an area opposite to the first guide rails portion. The upper chassis may be disposed on the first groove of the upper mold to reinforce a strong of the upper mold.

In an exemplary embodiment, the upper mold may include an injection molding material, and the upper chassis may include a metal material.

In an exemplary embodiment, the lower frame part may include a lower mold and a lower chassis. The lower mold may have a second groove formed on an area opposite to the second guide rails portion is formed. The lower chassis may be disposed on the second groove of the lower mold to reinforce a strong of the lower mold.

In an exemplary embodiment, the lower mold may include an injection molding material, and the lower chassis may include a metal material.

In an exemplary embodiment, the backlight unit may include a plurality of red light-emitting diodes, a plurality of green light-emitting diodes and a plurality of blue light-emitting diodes. The number of blue light-emitting diodes per unit area that are disposed in a middle area of the display panel between a central portion of the display panel and an extreme left or right edge portion may be greater than the corresponding number per unit area of red light-emitting diodes or of green light-emitting diodes that are disposed in the middle area.

In an exemplary embodiment, the backlight unit may include a plurality of red light-emitting diodes, a plurality of green light-emitting diodes and a plurality of blue light-emitting diodes. An average drive power applied to blue light-emitting diodes disposed in the middle area between the central portion of the display panel and an edge left or right portion may be greater than an average power applied to red light-emitting diodes or the number of green light-emitting diodes that are disposed in the middle area.

In an exemplary embodiment, when each of the display panel and the backlight unit fixed to the curved frame has a concave shape, a curvature radius of the backlight unit may be greater than a curvature radius of the display panel.

In an exemplary embodiment, the backlight unit may include a light source assembly configured for emitting lights and an optical assembly configured for enhancing characteristics of lights emitted from the light source assembly. A curvature radius of the optical assembly may be greater than a curvature radius of the display panel, and may be smaller than a curvature radius of the light source assembly.

In an exemplary embodiment, when each of the display panel and the backlight unit fixed to the curved frame has a convex shape, a curvature radius of the backlight unit may be smaller than a curvature radius of the display panel.

In an exemplary embodiment, the backlight unit may include a light source assembly configured for emitting lights and an optical assembly configured for enhancing characteristics of lights emitted from the light source assembly. A curvature radius of the optical assembly may be smaller than a curvature radius of the display panel, and may be greater than a curvature radius of the light source assembly.

Accordingly there are provided a curved frame matched to a curved display device having the display panel and an optionally curved backlighting unit. The curved frame has upper and lower guide rail portions formed therein and configured to secure and/or maintain corresponding and predetermined curvatures of the display panel and of the optionally curved backlight unit, for example so that the display panel and backlight unit, if they are both curved, are spaced apart from one another by a uniform distance. Thus, a backlight unit spaced apart from a display panel by a uniform distance can provide uniform intensity of backlighting lights to the display panel, so that display characteristics of the curved display device may be enhanced.

BRIEF DESCRIPTION OF THE DRAWINGS

The above and other features and aspects of the present disclosure of invention will become more apparent by describing in detailed exemplary embodiments thereof with reference to the accompanying drawings, in which.

DETAILED DESCRIPTION

Hereinafter, a curved frame and a curved display device having the curved frame according to the present disclosure of invention will be explained in detail with reference to the accompanying drawings.

Figure 1:
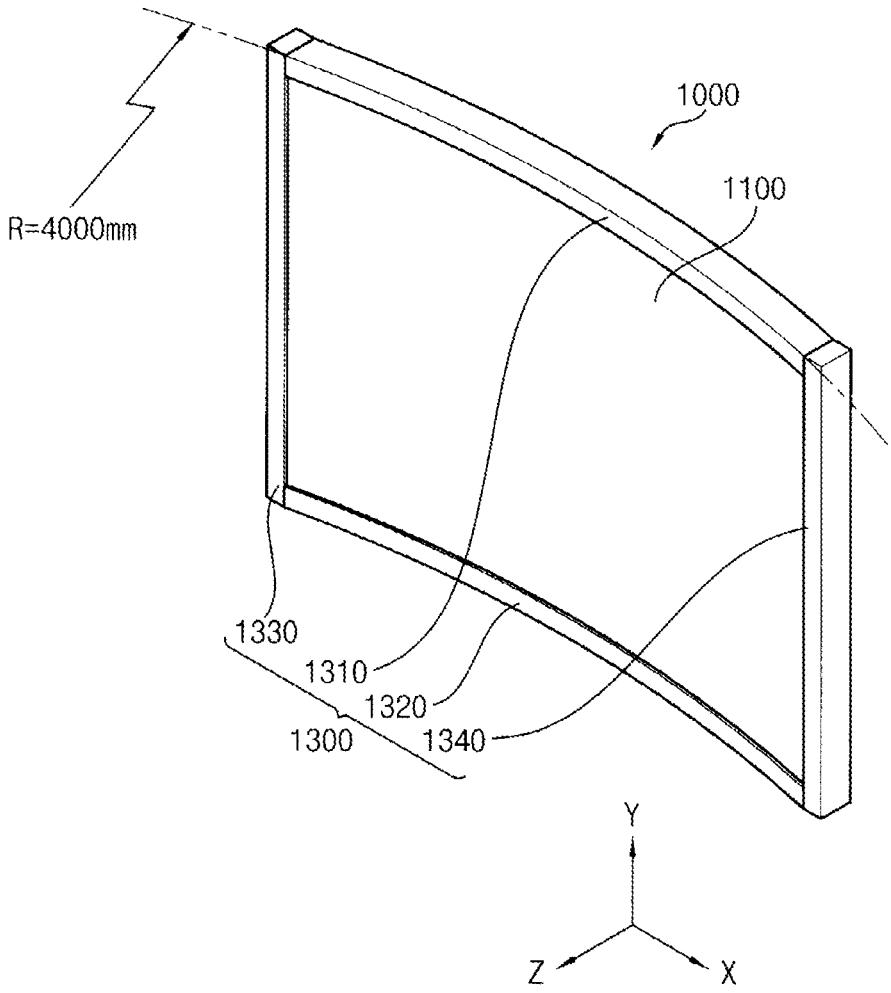
FIG. 1 is a perspective view schematically illustrating a curved display device according to an exemplary embodiment of the present disclosure.
Figure 2:
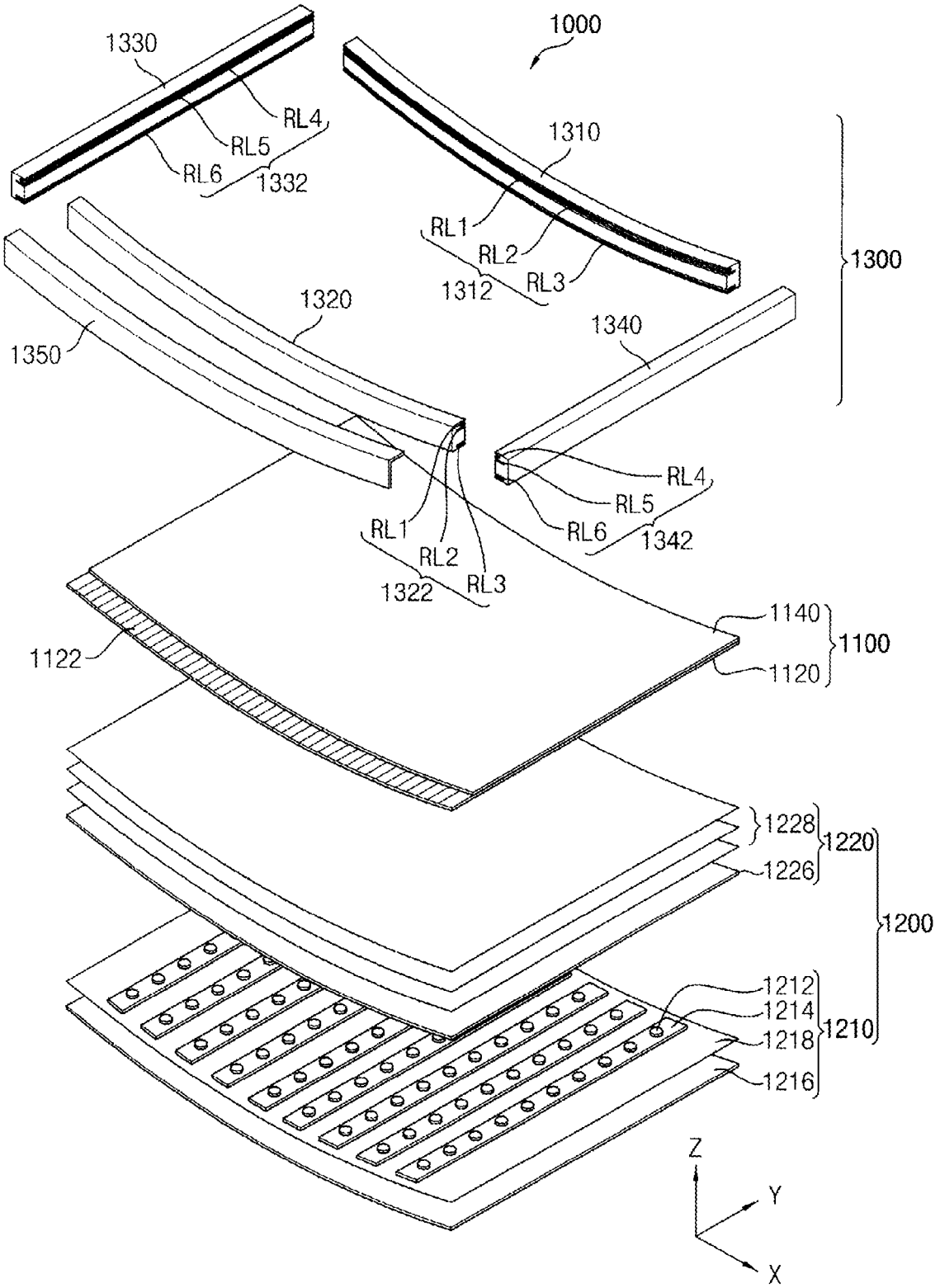
FIG. 2 is an exploded perspective view schematically illustrating the curved display device of FIG. 1.

FIG. 1 is a perspective view schematically illustrating a curved display device 1000 according to an exemplary first embodiment. FIG. 2 is an exploded perspective view schematically illustrating the curved display device 1000 of FIG. 1.

Referring to FIGS. 1 and 2, the illustrated curved display device 1000 includes a flexible display panel 1100, a flexible backlight unit 1200 and a concavely curved frame 1300 that is concavely bent to have a uniform curvature as seen cross sectionally when viewed with the X-Z plane being the plan view plane. A curvature radius corresponding to the curvature may be about 1,000 mm to about 4,000 mm although smaller or larger radii are also contemplated by the present disclosure of invention.

The display panel 1100 may have a curved shape of a uniform curvature when viewed from the X-Z plan view perspective (see the XYZ frame of reference provided in FIGS. 1-2). The display panel 1100 may be a liquid crystal display ("LCD") panel, a plasma display panel ("PDP"), an organic light-emitting display ("OLED") panel, an electrophoretic panel, etc. In the present exemplary embodiment, the display panel 1100 is taken as being a liquid crystal display panel including an array substrate 1120, a color filter substrate 1140 spaced apart from and facing the array substrate 1120, and a liquid crystal layer interposed between the array substrate 1120 and the color filter substrate 1140. The color filter substrate 1140 has a size sufficient to fully cover a display area (DA) of the array substrate 1120. However, the array substrate 1120 also has a non-displaying peripheral area (PA) bordering (e.g., 1122) or surrounding its display area (DA). Since the color filter substrate 1140 does not fully (or otherwise) cover the peripheral area (PA), the color filter substrate 1140 has a smaller major surface area than that of the array substrate 1120. Thus, an area (1122) not covered by the color filter substrate 1140 is exposed. An electrical interconnect pads part 1122 is formed on this exposed area of the array substrate 1120.

The display panel 1100 may be pre-curved before the display panel 1100 is inserted into the curved frame 1300. Alternatively, the display panel 1100 may be a flexible type that is curved into a desired nonlinear form as the display panel 1100 is inserted into the curved frame 1300. For one example, when the display panel 1100 is a flexible type, the display panel 1100 may be curved as the display panel 1100 is inserted into the curved frame 1300. For another example, when the display panel 1100 is a ridge type, the display panel 1100 may be manufactured to have a curved shape of a predetermined curvature before the display panel 1100 is inserted into the curved frame 1300.

The display panel 1100 may come to have its curved shape by various manufacturing methods. For example, a bendable flat display panel is disposed between a first curved mold of a convex shape and a second curved mold of a concave shape facing the first curved mold, and then the display panel 1100 may be manufactured through a heat treatment and a pressing treatment. In this case, a bottom surface of an array substrate of the flat display panel is disposed to contact with the first curved mold.

The array substrate is a substrate on which a plurality of first thin-film transistors (TFTs) that are used as pixel switching elements are formed in a matrix shape. In the present exemplary embodiment, the array substrate 1120 has a curved shape of uniform curvature. Each TFT has a source terminal connected to a respective data line, a gate terminal connected to a respective gate line, and a drain terminal connected to a respective pixel electrode made of a transparent conductive material. The electrical interconnect pads part 1122 may include a data pad parts 1122*d* whose pads (not individually shown) may form terminal parts of conductive lines integrally extended on the array substrate 1120 from a plurality of regularly spaced apart data lines (not shown) disposed in the display area (DA) of the array substrate 1120. Additionally or alternatively, the electrical interconnect pads part 1122 may include a gate pads part 1122*g* whose pads (not individually shown) may form terminal parts of conductive lines integrally extended from plural gate lines that are further disposed in the display area (DA) of the array substrate 1120.

The color filter substrate 1140 is disposed to face the array substrate 1120. The color filter substrate 1140 may include primary color filters such as those for a red pixel, a green pixel and a blue pixel that are used to realize other colors by way of mixed primary intensities. In the present exemplary embodiment, the color filter substrate 1140 has a curved shape of uniform curvature. A common electrode is formed on the color filter substrate 1140, which is opposite to individual pixel electrodes formed on the array substrate 1120. The common electrode includes an optically transparent and electrically conductive material (e.g., ITO, IZO).

Alternatively, the display panel 1100 may include an array substrate having the color filters integrally formed thereon, where the opposition substrate has a common electrode formed thereon to face the array substrate.

When a power is applied to a gate terminal of a TFT and the TFT is turned on, a data signal is passed through the TFT to its pixel-electrode, an electric field is generated between the pixel electrode and the common electrode. The electric field varies an aligning angle of the liquid crystal molecules interposed between the array substrate 1120 and the color filter substrate 1140. Thus, with aid of polarizing plates or sheets, a light transmittance of the liquid crystal layer is varied in accordance with the variation of the aligning angle of the liquid crystal, so a desired image may be obtained.

The display panel 1100 may include a first polarization film (not shown) disposed below the array substrate 1120 and a second polarization film (not shown) disposed on the color filter substrate 1140. The first polarization film includes a light transmitting axis of a first direction to polarize lights in a first direction. The second polarization film includes a light transmitting axis of a second direction to polarize lights in a second direction. For example, the light transmitting axis of the first polarization film may perpendicular to the light transmitting axis of the second polarization film.

The backlight unit 1200 is disposed behind a rear surface of the display panel 1100 to provide lights to the pixels of the curved display panel 1100. In the present exemplary embodiment, the backlight unit 1200 may have a curved shape which is bent in accordance with a curvature of the display panel 1100 so that spacing between the two is uniform. In the present exemplary embodiment, a curvature radius of the backlight unit 1200 may be about 1,000 mm to about 5,000 mm. In the present exemplary embodiment, when the display panel 1100 has a curvature radius of one of about 1,000 mm to about 4,000 mm, the backlight unit 1200 may have a curvature radius greater than a curvature radius of the display panel 1100 so that spacing between the two is substantially uniform. For example, when the display panel 1100 has a curvature radius of about 3,000 mm, the backlight unit 1200 may have a curvature radius greater than about 3,000 mm but smaller than about 5,000 mm.

The backlight unit 1200 includes a light source assembly 1210 configured for emitting lights and a optical assembly 1220 configured for enhancing light characteristics emitted from the light source assembly 1210. In the present exemplary embodiment, a curvature radius of the optical assembly 1220 may be greater than a curvature radius of the display panel 1100, and may be smaller than a curvature radius of the light source assembly 1210. The curvature radii discussed herein are measured from a common center point, for example an optimal viewing spot for a user of the display apparatus such that all his or her lines of sight (LOS's) are normal to the curved surface of the display panel.

The light source assembly 1210 includes a plurality of light-emitting diode packages 1212 configured for emitting lights and a plurality of printed circuit boards (e.g., strip or bar shaped ones) 1214 on which the light-emitting diode packages 1212 are mounted. A signal wiring (not shown) for providing the light-emitting diode packages 1212 with driving voltages, is integrally formed on each printed circuit board 1214. Circuit board strips 1214 of the light source assembly 1210 may be elongated in correspondence with a direction parallel with a long side of the display panel 1100. Alternatively, circuit board strips 1214 of the light source assembly 1210 may be elongated in correspondence with a direction parallel with a short side of the display panel 1100.

In the present exemplary embodiment, a distance between the light-emitting diode packages 1212 and the display panel 1100 is substantially uniform about the full curvature of the display panel.

During manufacture, where a flat display panel is bent to be a curved display panel 1100 having a concave shape, its color filter substrate 1140 is compressed to induce a buckling phenomenon. When the buckling phenomenon is generated, a cell gap of a liquid crystal layer may be undesirably increased in correspondence with a corresponding area. When a cell gap of a liquid crystal layer is increased in correspondence with a specific portion of a display panel, a blue transmittance ratio is decreased relative to other portions of the display panel so that yellowish coloring effect may be undesirably generated. However, in the present exemplary embodiment, in order to prevent a decrease of the blue transmittance ratio thus inducing the yellowish effect, a variation in the disposing or structuring of the light-emitting diode packages 1212 is provided. More specifically, and for example, when viewed from an X-Y plan of the display panel 1100, an intentional increase in the light amount of blue relative to the other primary colors is electronically or otherwise imposed, so that the blues which are emitted from the light-emitting diode packages 1212 disposed on a middle area between a central portion parallel with Y-axis and an edge portion parallel with Y-axis, may be increased. For one example, it may be effected by increasing the number of blue LEDs per unit area relative to the number of red LEDs or the number of green LEDs, thereby increasing a light amount of blue. For another example, it may increase a voltage provided to the blue LED's as compared to the voltages provided to a red LED or a voltage provided to a green LED, thereby increasing a light amount of blue. Alternatively, both the physical and electronically controlled methods of increasing luminance in the blue part of the color gamut may be employed.

The light source assembly 1210 may further include a bottom plate 1216 and a reflection sheet 1218.

The bottom plate 1216 has a curved shape of a uniform curvature to secure the circuit board strips 1214 of the light source assembly 1210 thereon. In the present exemplary embodiment, the bottom plate 1216 secures the bar shaped (elongated) printed circuit boards 1214 having light-emitting diode packages 1212 mounted thereon. In the present exemplary embodiment, the bottom plate 1216 may have a curved shape by various manufacturing methods. For example, a flat bottom plate is disposed between a first curved mold of a convex shape and a second curved mold of a concave shape facing the first curved mold, and then the bottom plate 1216 may be manufactured through a heat treatment and a pressing treatment for example for hardening a polymer included therein. In this case, a bottom surface of the flat bottom plate is disposed to contact with the first curved mold.

The reflection sheet 1218 is disposed on the bottom plate 1216 and is disposed below the light source assembly 1210 to reflect lights incident from the light source assembly 1210 toward the diffusion plate 1226.

The optical assembly 1220 may include a diffusion plate 1226 and optical sheets 1228.

The diffusion plate 1226 has a curved shape of uniform curvature. The diffusion plate 1226 diffuses lights emitted from the light source assembly 1210 or lights reflected by the reflection sheet 1218 to provide the optical sheets 1228 with the diffused lights. In the present exemplary embodiment, the diffusion plate 1226 may have a curved shape by various manufacturing methods. For example, a flat diffusion plate is disposed between a first curved mold of a concave shape and a second curved mold of a convex shape facing the first curved mold, and then the diffusion plate 1226 may be manufactured through a heat treatment and a pressing treatment. In this case, a bottom surface of the flat bottom plate is disposed to contact with the first curved mold.

The optical sheets 1228 are disposed on the diffusion plate 1226 to increase efficiency of lights incident from the diffusion plate 1226. The optical sheets 1228 may include a diffusion sheet again diffusing lights diffused by the diffusion plate 1226 and a prism sheet condensing the lights diffused by the diffusion sheet. For one example, the prism sheet may include a vertical prism sheet condensing lights in a vertical direction and a horizontal prism sheet condensing lights in a horizontal direction.

The curved frame 1300 into which the curved components of the display panel are received, includes an upper frame part 1310, a lower frame part 1320, a left frame part 1330 and a right frame part 1340 where these are sized and shaped to fixedly secure the display panel 1100 and the backlight unit 1200 therein. The curved frame 1300 has a curved shape with uniform curvatures corresponding to those of the curved components of the received display panel.

More specifically, a first guide rails portion 1312 is provided in the upper frame part 1310, where the first guide rails portion 1312 is bent to have a first set of curvatures (e.g., guide rails or recesses) to guide and/or to correspond with the curvatures of components of an upper side of the display panel 1100 and of an upper side of the backlight unit 1200.

Similarly, a second guide rails portion 1322 is provided in the lower frame part 1320, where the second guide rails portion 1322 is bent to have a corresponding second set of curvatures (e.g., guide rails or recesses) to guide and/or to correspond with the curvatures of components of a lower side of the display panel 1100 and of a lower side of the backlight unit 1200.

More specifically, in the present exemplary embodiment, each of the first and second guide rails portions 1312 and 1322 includes a respective first rail RL1, second rail RL2 and third rail RL3.

Figure 4:
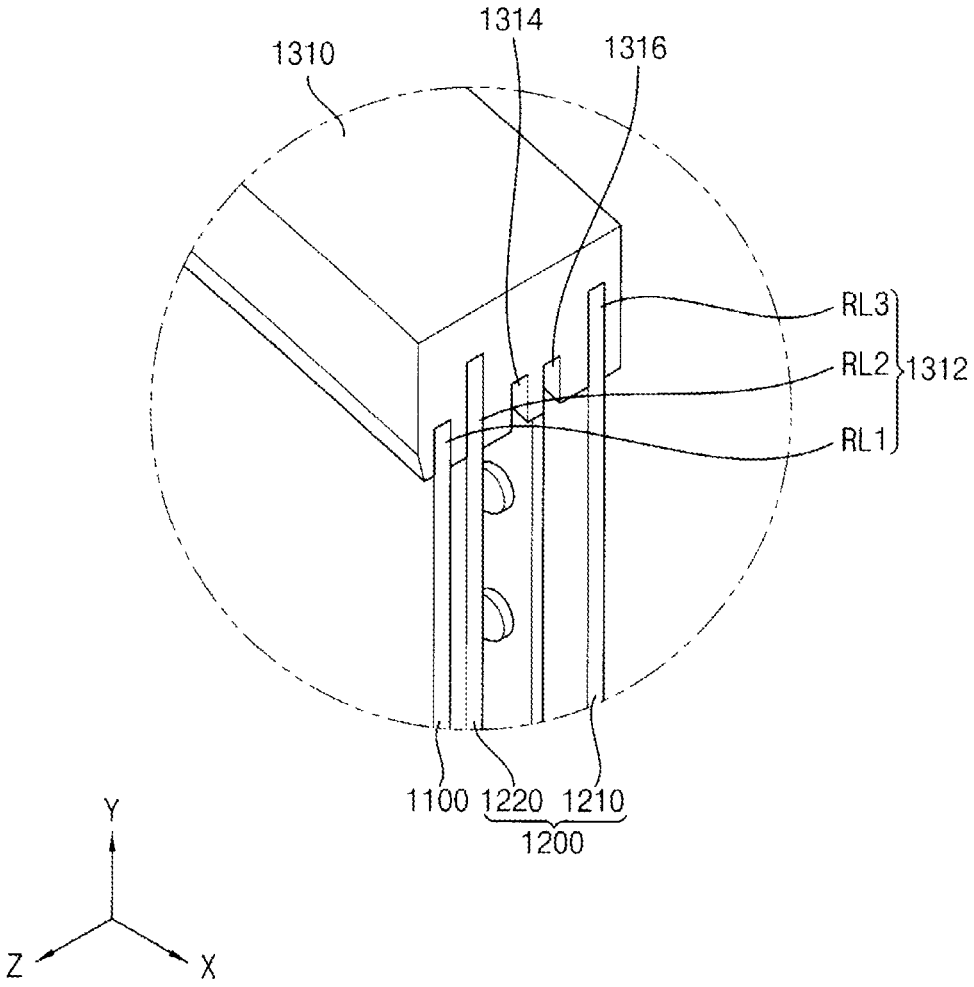
FIG. 4 is a partially enlarged view illustrating a curved display panel, an optical assembly and a light source assembly inserted into an upper frame part of FIG. 2.

Referring also to the perspective view of FIG. 4, the first rail (or recess) RL1 is a curved receiving pocket that is formed adjacent to a front surface of corresponding frame part to receive, secure and/or guide a correspondingly curved upper side (or a lower side) of the display panel 1100. In other words, the first rail RL1 is bent to correspond to an upper side (or a lower side) of the display panel 1100 having a curved shape of a respective uniform curvature.

Similarly, the second rail (or recess) RL2 is formed behind (rearward of) the first rail RL1 to receive, secure and/or guide a correspondingly curved upper side (or a lower side) of the optical assembly 1220 of the backlight unit 1200. In other words, the second rail RL2 is bent to correspond to the optical assembly 1220 having a curved shape of a respective uniform curvature.

Moreover, the third rail (or recess) RL3 is formed behind (rearward of) the second rail RL2 but in front of the rear surface of the corresponding frame part and structured to receive, secure and/or guide a correspondingly curved upper side (or a lower side) of the light source assembly 1210 of the backlight unit 1200. In other words, the third rail RL3 is bent to correspond to the light source assembly 1210 having a curved shape of a respective uniform curvature.

The left frame part 1330 has a straight line (linear) shape to be combined with a mating first end of the upper frame part 1310 and a mating first end of the lower frame part 1320. The combining may be realized through nuts, bolts, etc. A third guide rails portion 1332 is formed through the left frame part 1330 so as to guide a left side of the display panel 1100 and a left side of the backlight unit 1200.

The right frame part 1340 similarly has a straight line shape to be combined with a second end of the upper frame part 1310 and a second end of the lower frame part 1320. The combining may be realized through nuts, bolts, etc. A fourth guide rails portion 1342 is formed through the right frame part 1340 so as to guide a right side of the display panel 1100 and a right side of the backlight unit 1200.

In the present exemplary embodiment, each of the third and fourth guide rails portions 1332 and 1342 includes a respective fourth rail RL4, fifth rail RL5 and sixth rail RL5.

The fourth rail RL4 is formed adjacent to a front surface of corresponding frame part to guide a left side (or a right side) of the display panel 1100. In the present exemplary embodiment, since left side and right side of the display panel 1100 are of a straight line shape, the fourth rail RL4 has a straight line shape.

The fifth rail RL5 is formed behind the fourth rail RL4 to guide a left side (or a right side) of an optical assembly 1220 of the backlight assembly 1220. In the present exemplary embodiment, since left side and right side of the optical assembly 1220 are of a straight line shape, the fifth rail RL5 has a straight line shape.

The sixth rail RL6 is formed behind the fifth rail RL5 and forward of a rear surface of a corresponding frame part to guide a light source assembly 1210 of the backlight assembly 1200. In the present exemplary embodiment, since left side and right side of the light source assembly 1210 are of a straight line shape, the sixth rail RL6 has a straight line shape.

The curved frame 1300 may further include a frame cover 1350 covering the lower frame part 1320.

Figure 3:
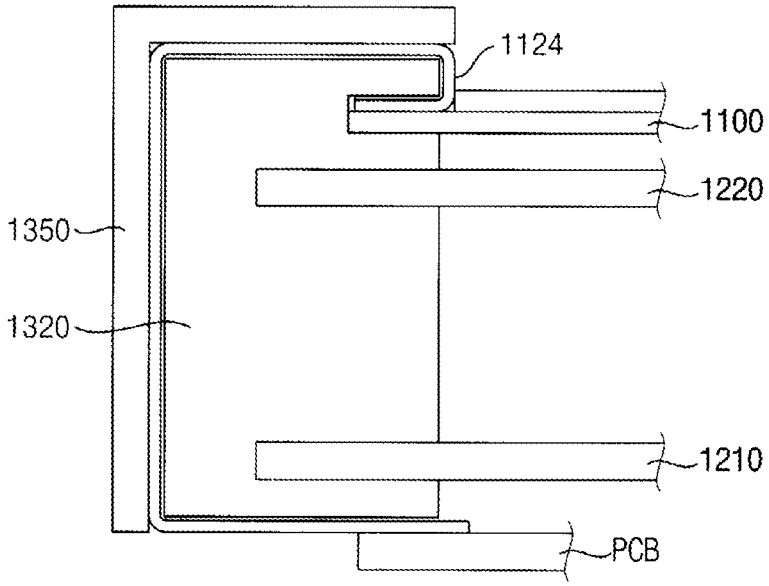
FIG. 3 is a cross-sectional view schematically illustrating a frame cover coupled to a lower frame part of FIG. 2.

FIG. 3 is a cross-sectional view schematically illustrating a frame cover 1350 coupled to a front portion of the lower frame part 1320 of FIG. 2.

Referring to FIGS. 2 and 3, a lower side of the display panel 1100 is inserted into a lower frame part 1320. A flexible film 1124 (e.g., one having contacts and printed circuit conductors) may be attached to the electrical contact pads portion 1122 of the display panel 1100. The flexible film 1124 may be bent along a front surface, a side surface and a rear surface of the lower frame part 1320. The flexible film 1124 may be attached to a printed circuit board PCB (as shown in FIG. 3) on an area adjacent to a rear surface of the lower frame part 1320. The printed circuit board PCB may be configured to provide the display panel 1100 with various signals for driving the display panel 1100 through the flexible film 1124. In the present exemplary embodiment, the frame cover 1350 may be combined with the lower frame part 1320 to cover the flexible film 1124 bent along a surface of the lower frame part 1320. Thus, the frame cover 1350 may protect the flexible interconnect film from an external foreign substance.

Figure 5:
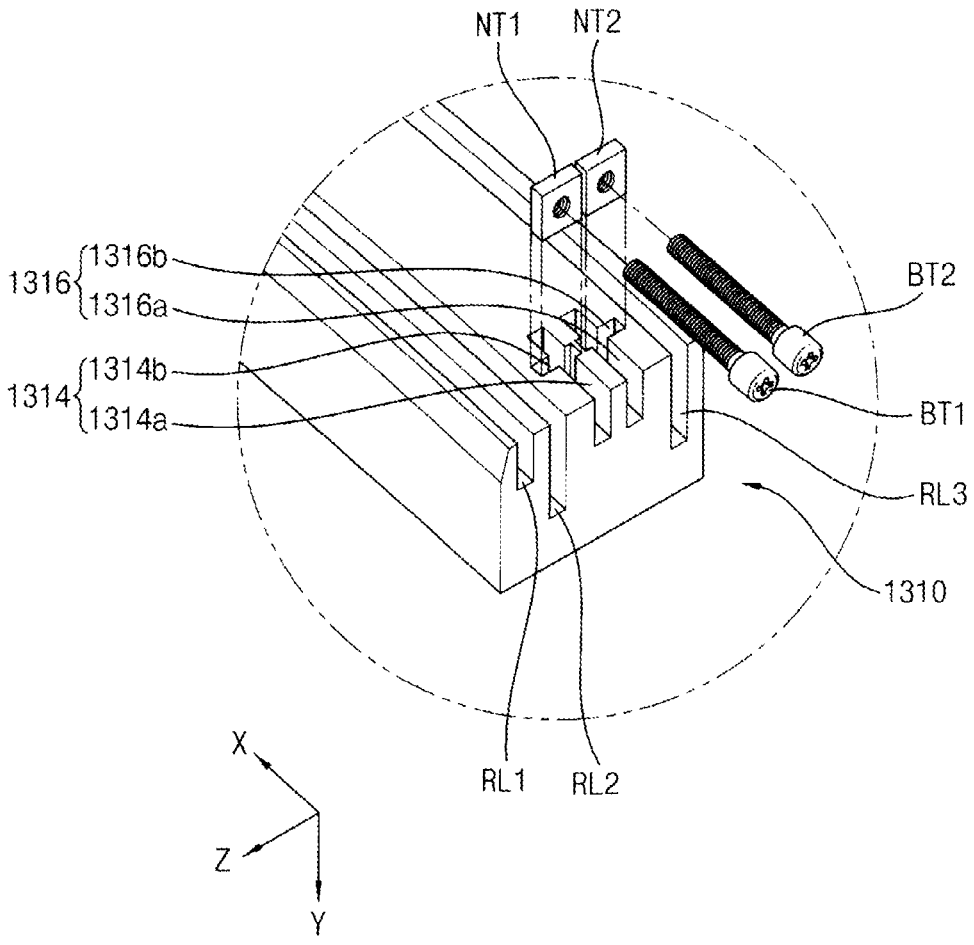
FIG. 5 is a partially enlarged view illustrating a coupling part formed through an upper frame part of FIG. 2.
Figure 6:
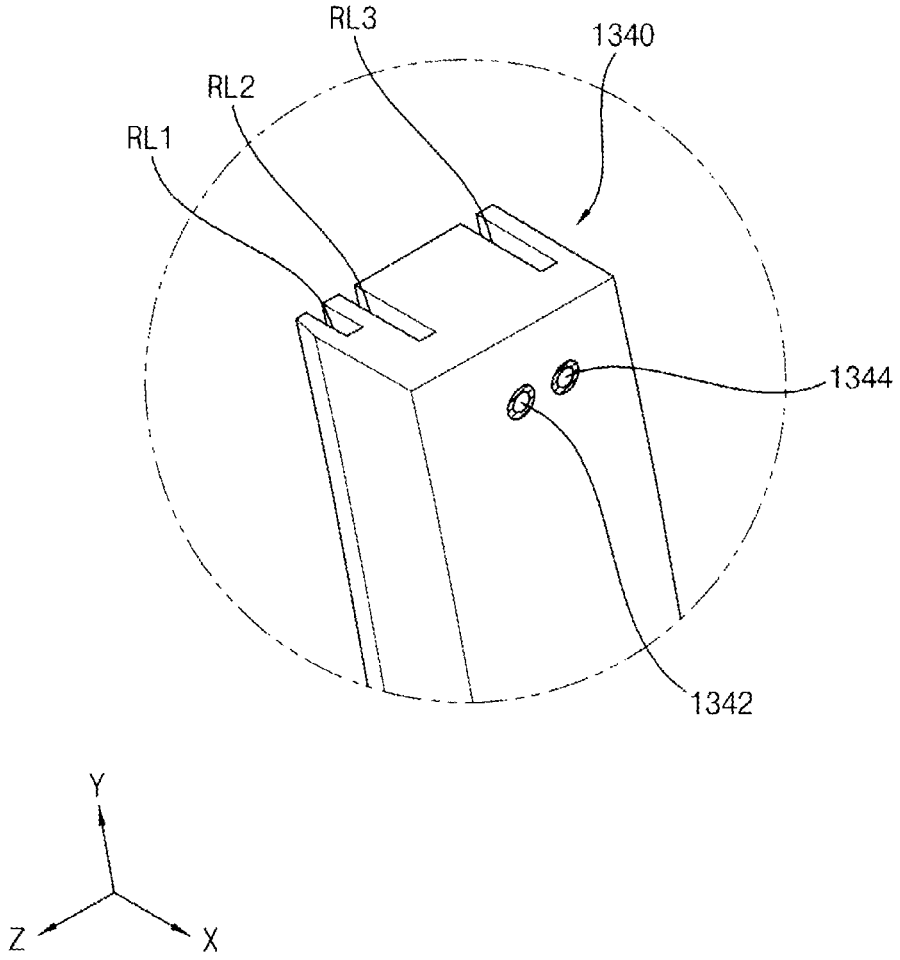
FIG. 6 is an enlarged view illustrating a right frame part of FIG. 2.

FIG. 4 is a partially enlarged view illustrating a display panel 1100, an optical assembly 1220 and a light source assembly 1210 inserted into an upper frame part 1310 of FIG. 2. FIG. 5 is a partially enlarged view illustrating a coupling part formed through an upper frame part 1310 of FIG. 2. FIG. 6 is an enlarged view illustrating a right frame part 1340 of FIG. 2.

Referring to FIGS. 2, 4, 5 and 6, a first guide rails portion 1312 formed on the upper frame part 1310 has a uniform curvature and includes the first rail RL1, second rail RL3 and third rail RL3 that are parallel with each other and uniformly spaced apart from each other.

The first rail RL1 is formed adjacent to a front surface of the upper frame part 1310 to guide an upper side of the display panel 1100. In the present exemplary embodiment, the front surface is a surface adjacent to a viewer viewing an image displayed on the curved display device 1000. The first rail RL1 is bent to correspond to the predetermined curvature of an upper side of the display panel 1100 having such a predetermined curved shape of a uniform curvature.

The second rail RL2 is formed behind the first rail RL1 to guide the optical assembly 1220 of the backlight unit 1200. The second rail RL2 is bent to correspond to the optical assembly 1220 having a curved shape of a uniform curvature. In the present exemplary embodiment, the optical assembly 1220 includes a diffusion plate 1226 and optical sheets 1228 also received into and guided by the second rail RL2. In this case, the optical sheets 1228 disposed adjacent to the display panel 1100 may be exposed to air, thereby generating a sheet warping.

In order to prevent a sheet warping, an additional transparent plate (not shown) may be further disposed. The transparent plate may have a curved shape of a uniform curvature. That is, the optical sheets 1228 are disposed between the transparent plate and the diffusion plate 1226 to prevent a sheet warping of the optical sheets 1228.

The third rail RL3 is formed behind the second rail RL2 and in front of a rear surface of the upper frame part 1310 and is shaped and sized to secure and guide a light source assembly 1210 of the backlight unit 1200. The third rail RL3 is bent to correspond to the light source assembly 1210 having a curved shape of a uniform curvature. A distance between the second rail RL2 and the third rail RL3 may be appropriately greater than a distance between the first rail RL1 and the second rail RL2.

In order to insert the upper side of the display panel 1100 into the first rail RL1, the display panel 1100 may be slidingly inserted into the first rail RL1 along the Y-axis direction or along the X-axis direction. Appropriate lubricants may be used, if practical, to ease the insertion process. In the case of a flexible display panel and/or backlighting unit, appropriate means (e.g., resilient securing devices and/or adhesives) may be used to secure the flexible substrate(s) to their respective rail(s) in a stretch and curvature maintaining manner.

In order to dispose an upper side of the optical assembly 1220 on the second rail RL2, the optical assembly 1220 may be sliding into the second rail RL2 along the Y-axis direction or the X-axis direction.

In order to dispose an upper side of the light source assembly 1210 on the third rail RL3, the light source assembly 1210 may be sliding into the third rail RL3 along the Y-axis direction or the X-axis direction.

In the example of FIG. 5, a first nut inserting (receiving) groove 1314 and a second nut inserting (receiving) groove 1316 are formed through an edge portion of the upper frame part 1310, and a first bolt inserting (receiving) groove 1342 and a second bolt inserting (receiving) groove 1344 are formed through an edge portion of the right frame part 1340. A first nut NT1 (e.g., a square shaped nut as shown) is inserted into the first nut inserting groove 1314. The first nut NT1 is coupled with a first bolt BT1 inserted through the first bolt inserting groove 1342 formed through the right frame part 1340. The second nut NT2 is coupled with a second bolt BT2 inserted through the second bolt inserting groove 1344 formed through the right frame part 1340.

Each of the first and second nut inserting grooves 1314 and 1316 forms a cross shape (X shape) with the corresponding bolt inserting (receiving) groove when viewed from an X-Y plan. For example, the first nut inserting groove 1314 has a cross shape configured by a first long groove 1314*a* and a first short groove 1314*b*. The first nut NT1 is disposed through the first short groove 1314*b*, and the first bolt BT1 inserted through a first edge portion of the first long groove 1314*a* is penetrated through the first nut NT1 to be disposed at a second edge portion of the first long groove 1314*a*. Moreover, the second nut inserting groove 1316 has a cross shape configured by a second long groove 1316*a* and a second short groove 1316*b*. The second nut NT2 is disposed through the second short groove 1316*b*, and the second bolt BT2 inserted through a first edge portion of the second long groove 1316*a* is penetrated through the second nut NT2 to be disposed at a second edge portion of the second long groove 1316*a*.

As described above, according to the present exemplary embodiment, a concavely curved frame having guide rails portions formed therethrough is configured, so that it may maintain and/or secure respective curvatures of a concavely curved display panel and curvatures of an optical assembly and a light source assembly of a corresponding and concavely curved backlight unit.

Thus, a concavely curved backlight unit uniformly spaced apart from a concavely curved display panel by a desired uniform distance may be configured to provide uniform backlighting lights to the concavely curved display panel, so that display characteristics of a concavely curved display device may be enhanced. In such a concavely curved display device, various elements for providing lights with the concavely curved display panel are disposed in a rear surface of the concavely curved display panel. However, rails are formed through a concavely curved frame, so that a distance between various elements may be uniformly maintained by the rails.

Figure 7:
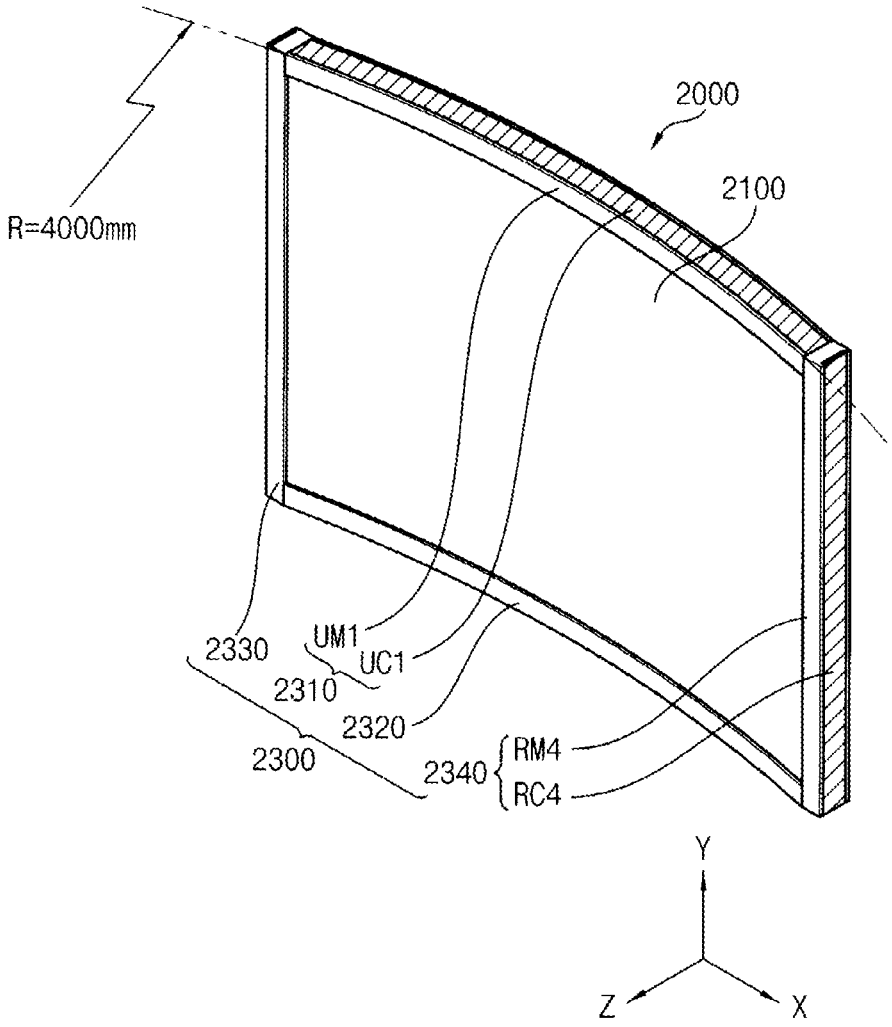
FIG. 7 is a perspective view schematically illustrating a curved display device according to another exemplary embodiment of the present disclosure.
Figure 8:
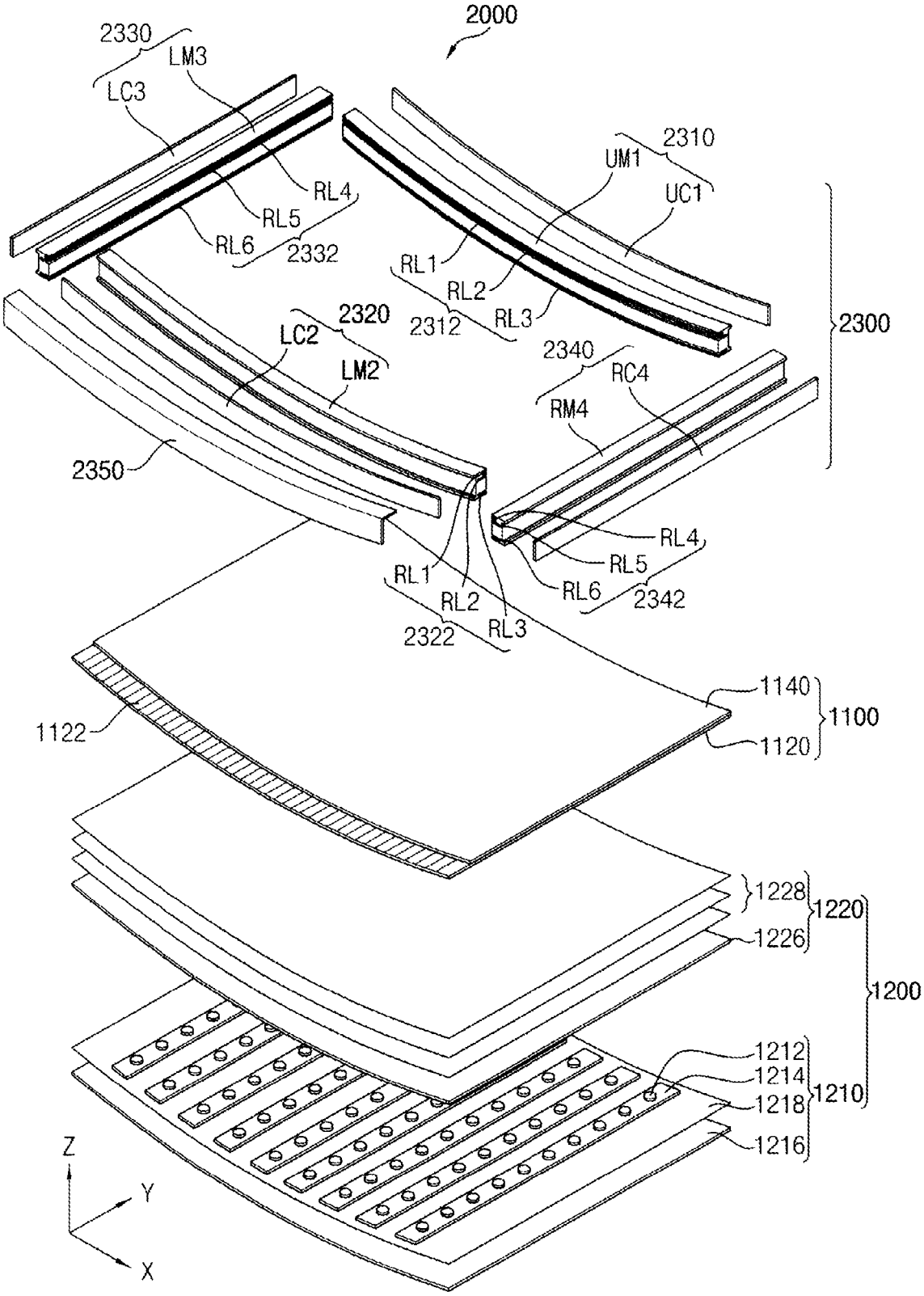
FIG. 8 is an exploded perspective view schematically illustrating a curved display device of FIG. 7.

FIG. 7 is a perspective view schematically illustrating a curved display device 2000 according to another exemplary embodiment of the present disclosure. FIG. 8 is an exploded perspective view schematically illustrating a curved display device 2000 of FIG. 7.

Referring to FIGS. 7 and 8, a curved display device 2000 according to this second exemplary embodiment includes a display panel 1100, a backlight unit 1200 and a concavely curved frame 2300 configured to be concavely bent to have a uniform curvature for viewing by a user facing an X-Y plan. A curvature radius corresponding to the curvature may be 1,000 mm to about 4,000 mm.

The display panel 2100 and the backlight unit 2200 may be substantially the same as the curved display panel 1100 and the backlight unit 1200 described with reference to FIG. 1, and thus any repetitive detailed explanation may hereinafter be omitted.

The curved frame 2300 includes an upper frame part 2310, a lower frame part 2320, a left frame part 2330 and a right frame part 2340.

The upper frame part 2310 includes a chassis-receiving upper mold part UM1 and a received upper chassis part UC1. A first guide rails portion 2312, which is bent to have a first curvature to guide an upper side of the display panel 1100 and an upper side of the backlight unit 1200, is formed through a first edge portion of the upper mold UM1. The first guide rails portion 2312 includes a first rail RL1, a second rail RL2 and a third rail RL3. The first rail RL1 is formed adjacent to a front surface of the upper frame part 2310 to guide an upper side of the display panel 1100. The second rail RL2 is formed in a rear surface of the first rail RL1 to guide an upper side of an optical assembly 1220 of the backlight unit 1200. The third rail RL3 is formed between a rear surface of the second rail RL2 and a rear surface of the upper frame part 2310 to guide an upper side of a light source assembly 1210 of the backlight unit 1200.

A first groove (best seen in FIG. 9) for receiving the upper chassis part UC1 (e.g., an aesthetic, i.e. chrome colored metal strip) is formed through a second edge portion of the upper mold UM1 which is opposite to the first guide rails portion 2312. The upper chassis UC1 is disposed on the first groove of the upper mold UM1 to reinforce a strong property of the upper mold UM1.

The lower frame part 2320 includes a lower mold LM2 and a lower chassis LC2. A second guide rails portion 2322, which is bent to have a first curvature to guide a lower side of the display panel 1100 and a lower side of the backlight unit 1200, is formed through a first edge portion of the lower mold LM2. The second guide rails portion 2322 includes a first rail RL1, a second rail RL2 and a third rail RL3. The first rail RL1 is formed adjacent to a front surface of the lower frame part 2320 to guide a lower side of the display panel 1100. The second rail RL2 is formed in a rear surface of the first rail RL1 to guide a lower side of an optical assembly 1220 of the backlight unit 1200. The third rail RL3 is formed between a rear surface of the second rail RL2 and a rear surface of the lower frame part 2320 to guide a lower side of a light source assembly 1210 of the backlight unit 1200. A second groove for receiving the lower chassis LC2 is formed through a second edge portion of the lower mold LM2 which is opposite to the second guide rails portion 2322. The lower chassis LC2 is disposed on the second groove of the lower mold LM2 to reinforce a strong property of the lower mold LM2.

The upper mold UM1 may be formed of an injection molding material, and the upper chassis UC1 may be a metal material. Moreover, the lower mold LM2 may be of an injection molding material, and the lower chassis UC2 may be of an appearance enhancing and strength providing metal material. In the present exemplary embodiment, a first rail RL1, a second rail RL2 and a third rail RL3 are formed through the upper mold UM1 and the lower mold LM2 so as to guide the display panel 110, the optical assembly 1220 of the backlight unit 1200 and the light source assembly 1210 of the backlight unit 1200. However, since the upper mold UM1 and the lower mold LM2 are an injection molding material, the upper mold UM1 and the lower mold LM2 may be easily manufactured to reduce a manufacturing cost. Moreover, a physical strength property of the upper mold UM1 and the lower mold LM2 is reinforced by the upper chassis UC1 and the lower chassis LC2.

The left frame part 2330 includes a left mold LM3 and a left chassis LC3 to be coupled with a first edge portion of the upper frame part 2310 and a first edge portion of the lower frame part 2320. A third guide rails portion 2332, which has a straight line shape to guide a left side of the display panel 1100 and a left side of the backlight unit 1200, is formed through a first edge portion of the left mold LM3. The third guide rails portion 2332 includes a fourth rail RL4, a fifth rail RL5 and a sixth rail RL6. The fourth rail RL4 is formed adjacent to a front surface of the left frame part 2330 to guide a left side of the display panel 1100. The fifth rail RL5 is formed in a rear surface of the fourth rail RL4 to guide a left side of an optical assembly 1220 of the backlight unit 1200. The sixth rail RL6 is formed between a rear surface of the fifth rail RL5 and a rear surface of the left frame part 2330 to guide a left side of a light source assembly 1210 of the backlight unit 1200. A third groove for receiving the left chassis LC3 is formed through a second edge portion of the left mold LM3 which is opposite to the second guide rails portion 2322. The left chassis LC3 is disposed on the third groove of the left mold LM3 to reinforce a strong property of the left mold LM3.

The right frame part 2340 includes a right mold RM4 and a right chassis RC4 to be coupled with a second edge portion of the upper frame part 2310 and a second edge portion of the lower frame part 2320. A fourth guide rails portion 2342, which has a straight line shape to guide a right side of the display panel 1100 and a right side of the backlight unit 1200, is formed through a first edge portion of the right mold RM4. The fourth guide rails portion 2342 includes a fourth rail RL4, a fifth rail RL5 and a sixth rail RL6. The fourth rail RL4 is formed adjacent to a front surface of the right frame part 2340 to guide a right side of the display panel 1100. The fifth rail RL5 is formed in a rear surface of the fourth rail RL4 to guide a right side of an optical assembly 1220 of the backlight unit 1200. The sixth rail RL6 is formed between a rear surface of the fifth rail RL5 and a rear surface of the right frame part 2340 to guide a right side of a light source assembly 1210 of the backlight unit 1200. A fourth groove for receiving the right chassis LC4 is formed through a second edge portion of the right mold LM4 which is opposite to the fourth guide rails portion 2342. The right chassis LC4 is disposed on the fourth groove of the right mold LM4 to reinforce a strength property of the lower mold LM2.

Figure 9:
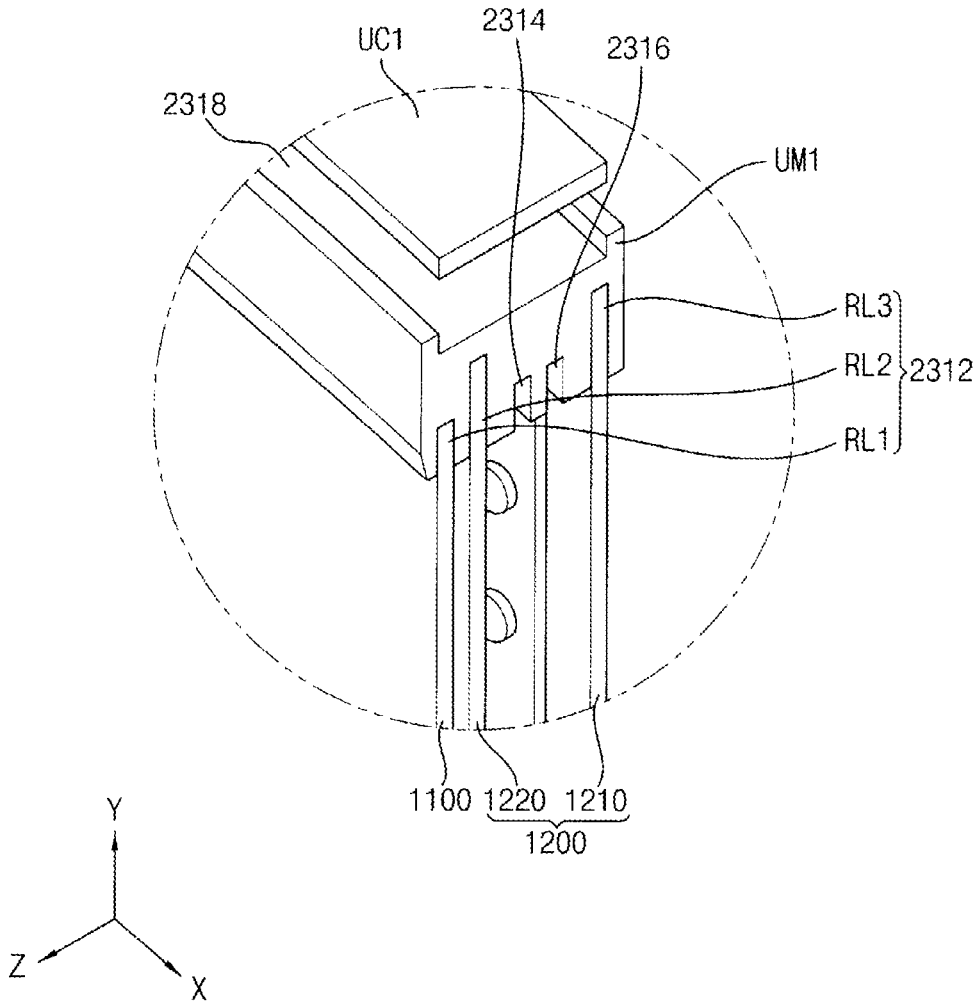
FIG. 9 is an enlarged view illustrating an upper frame part of FIG. 8.
Figure 10:
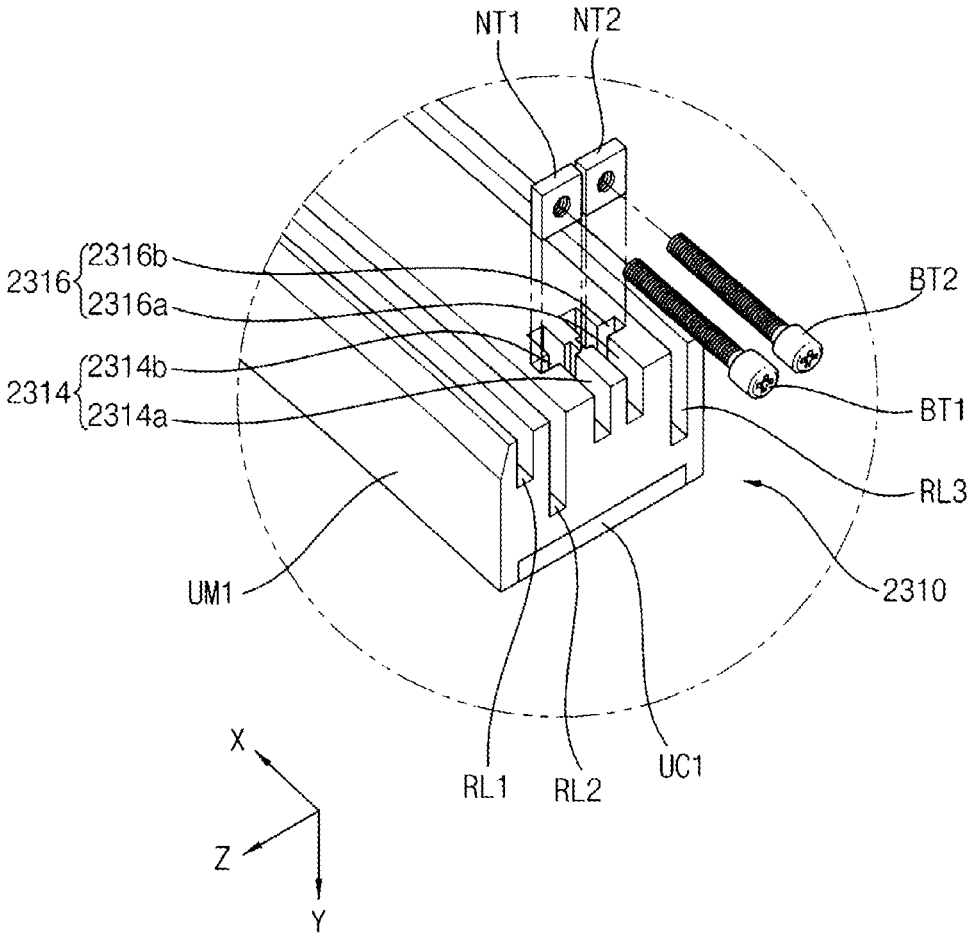
FIG. 10 is a partially enlarged view illustrating a coupling part formed through an upper frame part of FIG. 8.
Figure 11:
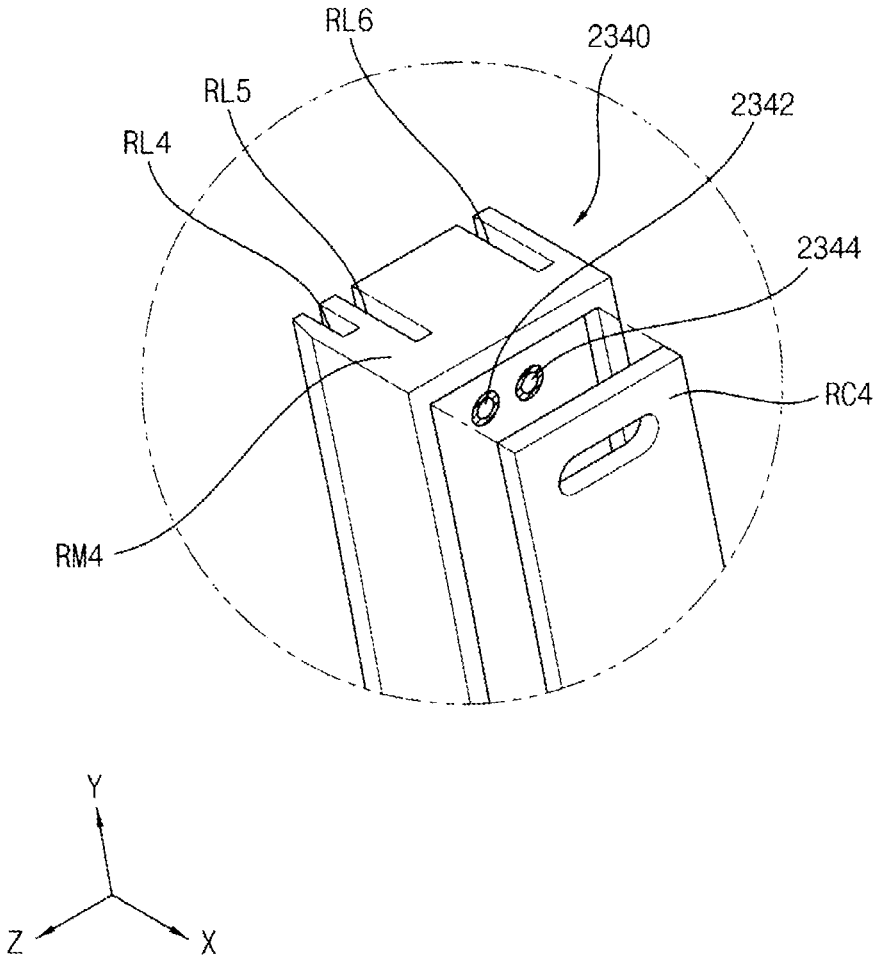
FIG. 11 is an enlarged view illustrating a right frame part of FIG. 8.

FIG. 9 is an enlarged view illustrating an upper frame part 2310 of FIG. 8. FIG. 10 is a partially enlarged view illustrating a coupling part formed through an upper frame part 2310 of FIG. 8. FIG. 11 is an enlarged view illustrating a right frame part 2340 of FIG. 8.

Referring to FIGS. 8, 9, 10 and 11, the upper frame part 2310 includes an upper mold UM1 and an upper chassis UC1, and the right frame portion 2340 includes a right mold RM4 and a right chassis RC4.

A first guide rail portion 2312 bent in a predetermined curvature is formed through a first portion of the upper mold UM1, and a first groove for receiving the upper chassis UC1 is formed through a second portion of the upper mold UM1. A depth of the first groove may correspond to a thickness of the upper chassis UC1.

The first guide rail portion 2312 has a curved shape of uniform curvature to include a first rail RL1, a second rail RL3 and a third rail RL3 that are parallel with each other. The first to third rails RL1, RL2 and RL3 are substantially the same as the first to third rails RL1, RL2 and RL3 described with reference to FIGS. 3 to 5, and thus any repetitive detailed explanation may hereinafter be omitted.

A first nut inserting groove 2314 and a second nut inserting groove 2316 are formed through an edge portion of the upper mold UM1, and a first bolt inserting groove 2342 and a second bolt inserting groove 2344 are formed through an edge portion of the right mold RM4. Each of the first and second nut inserting grooves 2314 and 2316 is substantially the same as each of the first and second nut inserting grooves 2314 and 2316 described with reference to FIGS. 4 to 6, and thus any repetitive detailed explanation may hereinafter be omitted. Each of the first and second bolt inserting grooves 2342 and 2344 is substantially the same as each of the first and second bolt inserting grooves 1342 and 1344 described with reference to FIGS. 4 to 6, and thus any repetitive detailed explanation may hereinafter be omitted.

The upper chassis UC1 is disposed on (e.g., and adhesively bonded to) a first groove of the upper mold UM1 to reinforce a strength property of the upper mold UM1. The upper chassis UC1 may have a bent plate shape. A width of the upper chassis UC1 is substantially smaller than a width of the upper mold UM1. The upper chassis UC1 is bent to have a first curvature.

Although not shown in FIGS. 8, 9, 10 and 11, a fourth guide rail portion is formed through a first portion of the right mold RM4, and a fourth groove for receiving the right chassis RC4 is formed through a second portion of the right mold RM4. A depth of the fourth groove may correspond to a thickness of the right chassis RC4.

The fourth guide rail portion includes a first rail RL1, a second rail RL3 and a third rail RL3. The first to third rails RL1, RL2 and RL3 may have a straight line shape to be parallel with each other. A right side of the display panel 1100 is inserted into the first rail RL1, a right side of the optical assembly 1220 is inserted into the second rail RL2, and a right side of the light source assembly 1210 is inserted into the third rail RL3.

Holes may be formed through edge portions of the right chassis RC4 in correspondence with the first and second bolt inserting grooves 2342 and 2344 that are formed through the right mold RM4. The first and second bolts BT1 and BT2 are inserted into the first and second bolt inserting grooves 2342 and 2344 that are formed through edge portions of the right mold RM4 through the holes, and are coupled with the first and second nuts NT1 and NT2 disposed at edge portions of the upper mold UM1.

As described above, according to the present exemplary embodiment, a concavely curved frame fixing a concavely curved display panel and a concavely curved backlight unit to have a uniform distance is configured by a mold of an injection molding material and a chassis of a metal material, so that it may reduce a weight and a manufacturing cost of a concavely curved frame. More specifically, by having a relatively small and uniform spacing apart between the curved backlighting unit and the curved display panel, less housing material is needed than would be the case if the backlighting unit were of the flat panel kind and thus the housing (e.g., molds and chassis pieces) weight less than would that of a system using a flat panel shaped backlighting unit. The saved weight may translate into saved shipping costs and saved handling costs.

That is, since first to third rails should be formed through a concavely curved frame so as to fix a concavely curved display panel and plural elements of a concave type backlight unit, a structure of the concavely curved frame is complex. If the concavely curved frame having a complex structure had to be manufactured entirely by using a rigid metal material, a manufacturing cost and a weight of concavely curved frame may be impractically increased.

However, a concavely curved mold having first to third rails formed therethrough is manufactured in an injection molding material, so that a manufacturing cost and a weight of the concavely curved mold may be much reduced. Moreover, plate-like metal chassis parts manufactured by a simple press process are attached (e.g., by appropriate adhesives) to the concavely curved mold, thereby increasing a strength of the concavely curved mold and optionally also improving its appearance.

Figure 12:
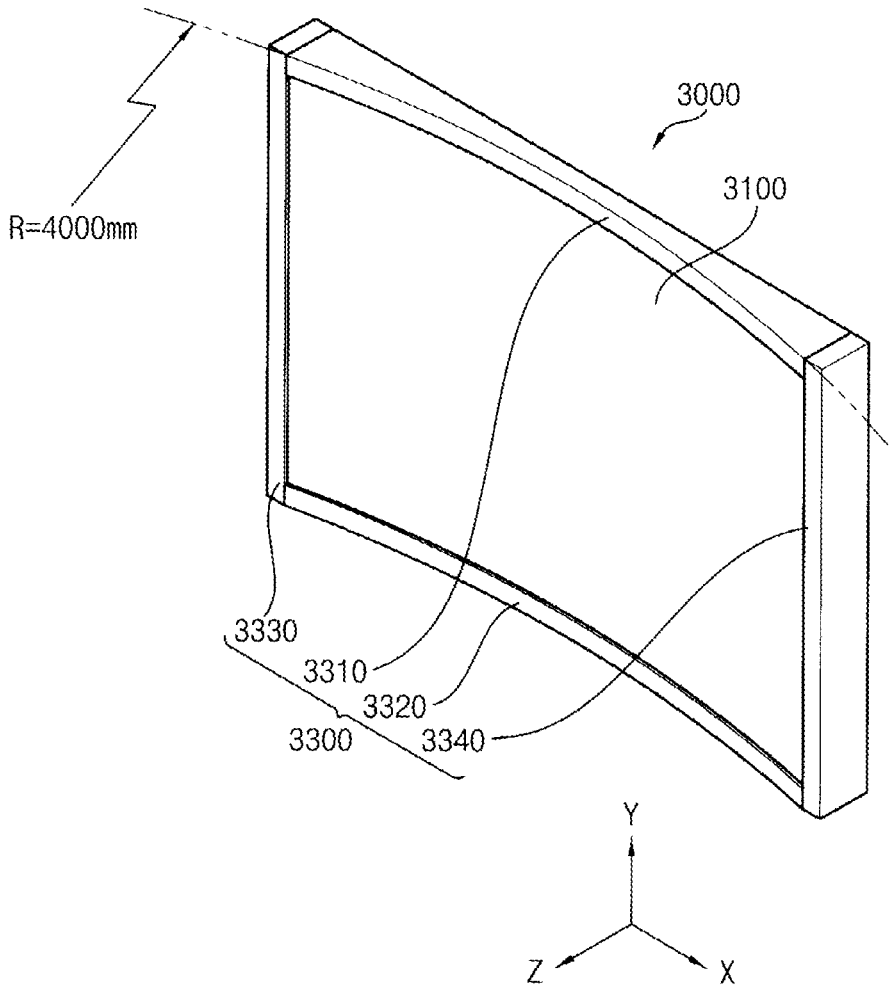
FIG. 12 is a perspective view schematically illustrating a curved display device according to still another exemplary embodiment of the present disclosure.
Figure 13:
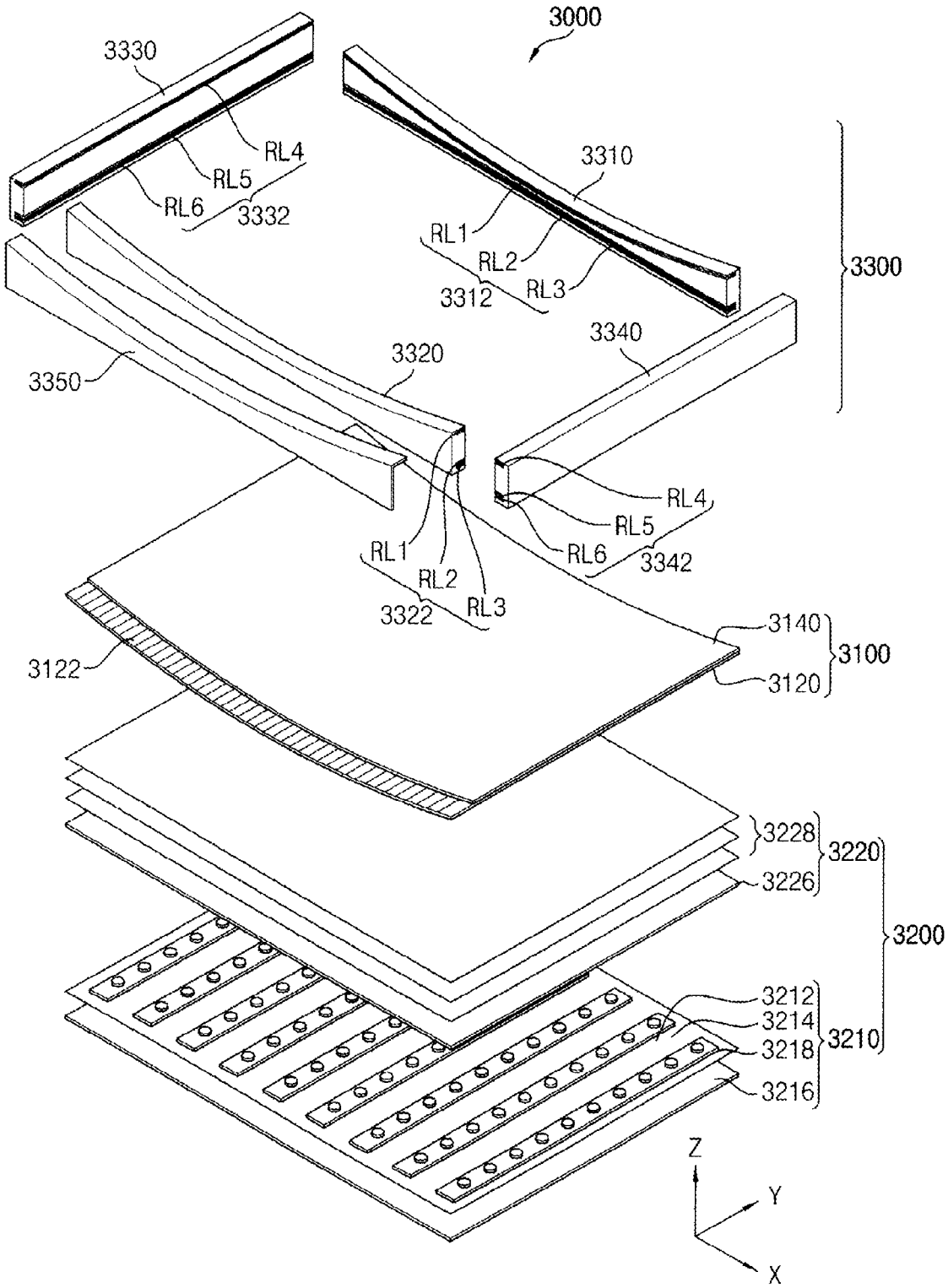
FIG. 13 is an exploded perspective view schematically illustrating a curved display device of FIG. 12.

FIG. 12 is a perspective view schematically illustrating a curved display device 3000 according to still another exemplary embodiment where this time a flat panel type of backlighting unit is used. FIG. 13 is an exploded perspective view schematically illustrating a curved display device 3000 of FIG. 12.

Referring to FIGS. 12 and 13, this curved display device 3000 according to the third exemplary embodiment includes a display pane 3100, a flat backlight unit 3200 and a concavely curved frame 3300. The display panel 3100 is concavely bent to have a uniform curvature when viewed by user facing the X-Y plane. In the present exemplary embodiment, a curvature radius corresponding to the curvature is about 4,000 mm. Alternatively, various curvature radii may be adapted thereto.

The display panel 3100 may have a curved shape of uniform curvature. The display panel 3100 may be substantially the same as the curved display panel 1100 described with reference to FIG. 2, and thus any repetitive detailed explanation may hereinafter be omitted.

The backlight unit 3200 is disposed at a rear surface of the display panel 3100 to provide lights to the display panel 3100. In the present exemplary embodiment, the backlight unit 3200 has a flat shape.

The backlight unit 3200 includes a light source assembly 3210 emitting lights and an optical assembly 3220 enhancing light characteristics emitted from the light source assembly 3210.

The light source assembly 3210 includes a plurality of light-emitting diode packages 3212 configured for emitting lights and a plurality of printed circuit board strips 3214 on which the light-emitting diode packages 3212 are mounted. A signal wiring (not shown) for providing the light-emitting diode packages 3212 with driving voltages, is formed on each of the printed circuit boards 3214. The elongated printed circuit board strips 3214 of the light source assembly 3210 may be disposed in correspondence with a direction parallel with a long side of the display panel 3100. Alternatively, the light source assembly 3210 may be disposed in correspondence with a direction parallel with a short side of the display panel 3100. Since distance to the curved display panel is different for each differently placed one of the elongated printed circuit board strips 3214, the intensity of lights emitted from each may be appropriately adjusted to counter-compensate for the difference in spacings.

More specifically, in the present exemplary embodiment, the display panel 3100 has a concavely curved shape while the backlight unit 3200 has a flat shape and thus, strength of light provided to the display panel may be varied if all the printed circuit board strips 3214 were operated or configured the same way. That is, a distance between a central portion of the display panel 3100 and the backlight unit 3200 is substantially smaller than a distance between left/right peripheral portion of the display panel 3100 and the backlight unit 3200.

However, in accordance with the present disclosure, backlighting lights provided to a central portion of the display panel 3100 are made comparatively weaker than backlighting lights provided to the extreme left/right peripheral portions of the display panel 3100 in order to compensate for the distance difference, so that a display characteristic of the curved display device is not degraded by the non-uniform spacing.

More specifically, in order to prevent display characteristics from being decreased, the number of the light-emitting diodes disposed per unit area on the respective printed circuit boards 3214 may be adjusted and/or an interval between the light-emitting diodes packages 3212 may be adjusted and/or the drive powers applied to the LED's may be adjusted to compensate for the respective spacing-to-display panel of each of the elongated printed circuit board strips 3214.

For one example, the number of light-emitting diodes corresponding to a central portion of the display panel 3100 may be decreased, and the number of light-emitting diodes corresponding to left/right peripheral portions of the display panel 3100 may be increased. For another example, an interval between the printed circuit boards corresponding to the central portion of the display panel 3100 may be decreased, and an interval between the printed circuit boards 3214 corresponding to the left/right peripheral portions of the display panel 3100 may be increased.

Alternatively and/or additionally, it may prevent display characteristics of a curved display device from being decreased by varying a driving power of the light source assembly 3210 even for example without varying a structure of the light source assembly 3210.

For example, a relatively low driving power (voltage and/or current and/or by way of pulse modulation) may be applied to light-emitting diodes corresponding to a central portion of the display panel 3100, and a relatively higher power (voltage and/or current and/or by way of pulse modulation) may be applied to light-emitting diodes corresponding to left/right peripheral portions of the display panel 3100.

Moreover, in order to prevent a blue transmittance ratio from being decreased by a buckling phenomenon generated in the curved display panel 3100, there may be provided a varying disposing or structuring or driving of the blue light-emitting diodes in packages 1212. For example, when viewed from an X-Y plan of the display panel 3100, a light amount of blue, which are emitted from the light-emitting diode packages 3212 disposed on a middle area between a central portion parallel with Y-axis and an edge portion parallel with Y-axis, may be increased. For one example, it may increase the number of blue LEDs rather than the number of red LEDs or the number of green LEDs, thereby increasing a light amount of blue. For another example, it may increase a power provided to a blue LED's relative to that provided to the red LED's and the green LED's, thereby increasing a light amount of blue.

The light source assembly 3210 may further include a bottom plate 3216 and a reflection sheet 3218.

The bottom plate 3216 has a flat shape to secure printed circuit boards 3214 having light-emitting diode packages 3212 mounted thereon.

The reflection sheet 3218 is disposed on the bottom plate 3216 and is disposed below (behind) the light source assembly 3210 to reflect lights incident from the light source assembly 3210 toward the diffusion plate 3226.

The optical assembly 3220 may include a diffusion plate 3226 and optical sheets 3228.

The diffusion plate 3226 has a flat shape to be disposed on the light source assembly 3210. The diffusion plate 3226 diffuses lights emitted from the light source assembly 3210 or lights reflected by the reflection sheet 3218 to provide the optical sheets 3228 with the diffused lights.

The optical sheets 3228 are disposed on the diffusion plate 3226 to increase efficiency of lights incident from the diffusion plate 3226. The optical sheets 3228 may include a diffusion sheet again diffusing lights diffused by the diffusion plate 3226 and a prism sheet condensing the lights diffused by the diffusion sheet. For one example, the prism sheet may include a vertical prism sheet condensing lights in a vertical direction and a horizontal prism sheet condensing lights in a horizontal direction.

The curved frame 3300 includes an upper frame part 3310, a lower frame part 3320, a left frame part 3330 and a right frame part 3340 to secure the display panel 3100 and the backlight unit 3200. The curved frame 3300 has a curved shape of uniform curvature when viewed from a front surface, and has a flat shape when viewed from a rear surface.

A first guide rail portion 3312, which is bent to have a first curvature to guide an upper side of the display panel 3100 and an upper side of the backlight unit 3200, is formed through the upper frame part 3310.

When it is viewed from an X-Z plan, a lower surface of the upper frame part 3310 has a straight line, and an upper surface of the upper frame part 3310 has a curved shape, that is a U-shape. A thickness of the upper frame part 3310 is gradually increased as one moves farther and outwardly along the frame from a central portion of the upper frame part 3310. The upper frame part 3310 may have vertical symmetry.

A second guide rail portion 3322, which is bent to have the first curvature to guide a lower side of the display panel 3100 and a lower side of the backlight unit 3200, is formed through the lower frame part 3320.

When it is viewed from an X-Z plan, a lower surface of the lower frame part 3320 has a straight line, and an upper surface of the lower frame part 3320 has a curved shape, that is a U-shape. A thickness of the lower frame part 3320 is gradually increased it going from a central portion of the lower frame part 3320 to a peripheral portion of the lower frame part 3320. The lower frame part 3320 may have vertical symmetry. A thickness varying ratio of the lower frame part 3320 is substantially equal to that of the upper frame part 3310.

The left frame part 3330 has a straight line shape to be combined with a first end of the upper frame part 3310 and a first end of the lower frame part 3320. The combining may be realized through nuts, bolts, etc. A third guide rail portion 3332 is formed through the left frame part 3330, which guides a left side of the display panel 3100, a left side of the optical assembly 3220 and a left side of the light source assembly 3210.

The right frame part 3340 has a straight line shape to be combined with a second end of the upper frame part 3310 and a second end of the lower frame part 3320. The combining may be realized through nuts, bolts, etc. A fourth guide rail portion 3342 is formed through the right frame part 3340, which guides a right side of the display panel 3100, a right side of the optical assembly 3220 and a right side of the light source assembly 3210.

Figure 14:
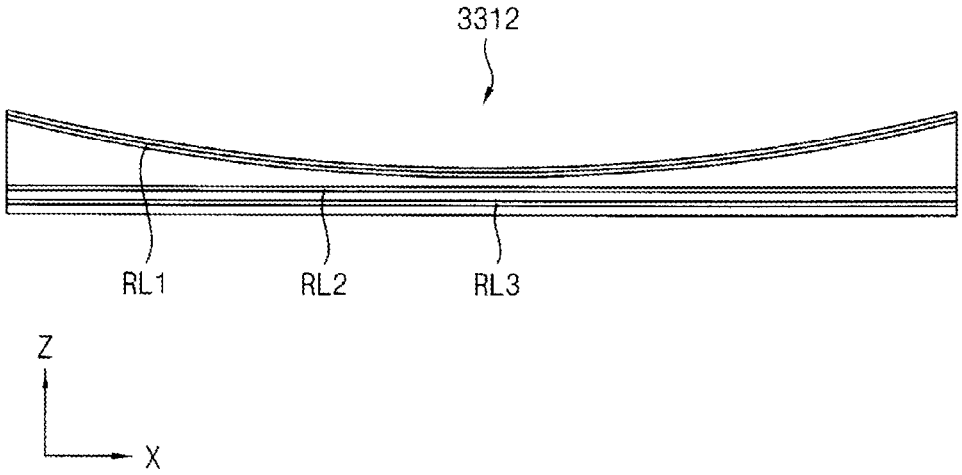
FIG. 14 is a plan view illustrating an upper frame part of FIG. 13.

FIG. 14 is a plan view illustrating an upper frame part of FIG. 13.

Referring to FIGS. 13 and 14, a first guide rail portion 3312 is formed through the upper frame part 3310 to guide an upper side of the display panel 3100 and an upper side of the backlight unit 3200. A second guide rail portion 3322 is formed through the lower frame part 3320 to guide a lower side of the display panel 3100 and a lower side of the backlight unit 3200.

In the present exemplary embodiment, each of the first and second guide rail portions 3312 and 3322 includes a first rail RL1, a second rail RL2 and a third rail RL3. The first rail RL1 is formed adjacent to a front surface of corresponding frame part to guide an upper side of the display panel 3100. The first rail RL1 is bent to correspond to an upper side of the display panel 3100 having a curved shape of a uniform curvature. A width of the first rail RL1 may be substantially equal to a width of the display panel 3100 inserted thereto.

The second rail RL2 is formed behind the first rail RL1 to guide the optical assembly 3220 of the backlight unit 3200. The second rail RL2 has a straight line shape to correspond with the optical assembly 3220 having a straight line shape. A width of the second rail RL2 may be substantially equal to a width of the optical assembly 3220 inserted thereto.

The third rail RL3 is formed between a rear surface of the second rail RL2 and a rear surface of a corresponding frame part to guide a light source assembly 3210 of the backlight unit 3200. The third rail RL3 has a straight line shape to correspond with the light source assembly 3210 having a straight line shape. A width of the third rail RL3 may be substantially equal to a width of the light source assembly 3210 inserted thereto.

The second rail RL2 and the third rail RL3 may parallel with each other. For one example, depths of the first, second and third rails RL1, RL2 and RL3 may be substantially equal to each other. For another example, depths of the first, second and third rails RL1, RL2 and RL3 may be different from each other.

As described above, according to the present exemplary embodiment, a concavely curved frame having a guide rail portion formed therethrough is configured, so that it may maintain a curvature of a concavely curved frame. Moreover, a concavely curved display panel and a flat backlight unit may be secured to a frame having a concavely curved frame part.

Accordingly, a screen having glare reducing property may be provided to a viewer viewing images through a concavely curved display device. Moreover, a conventional flat backlight unit may be utilized within the concavely curved display device.

Figure 15:
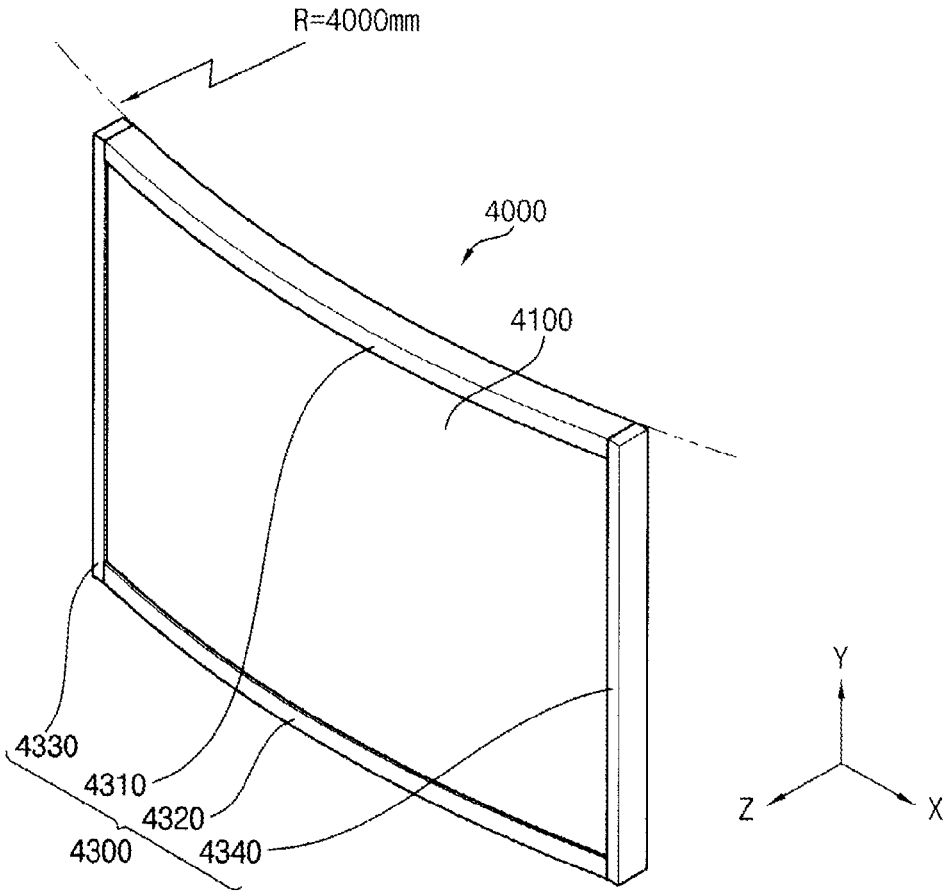
FIG. 15 is a perspective view schematically illustrating a curved display device according to more still another exemplary embodiment of the present disclosure.
Figure 16:
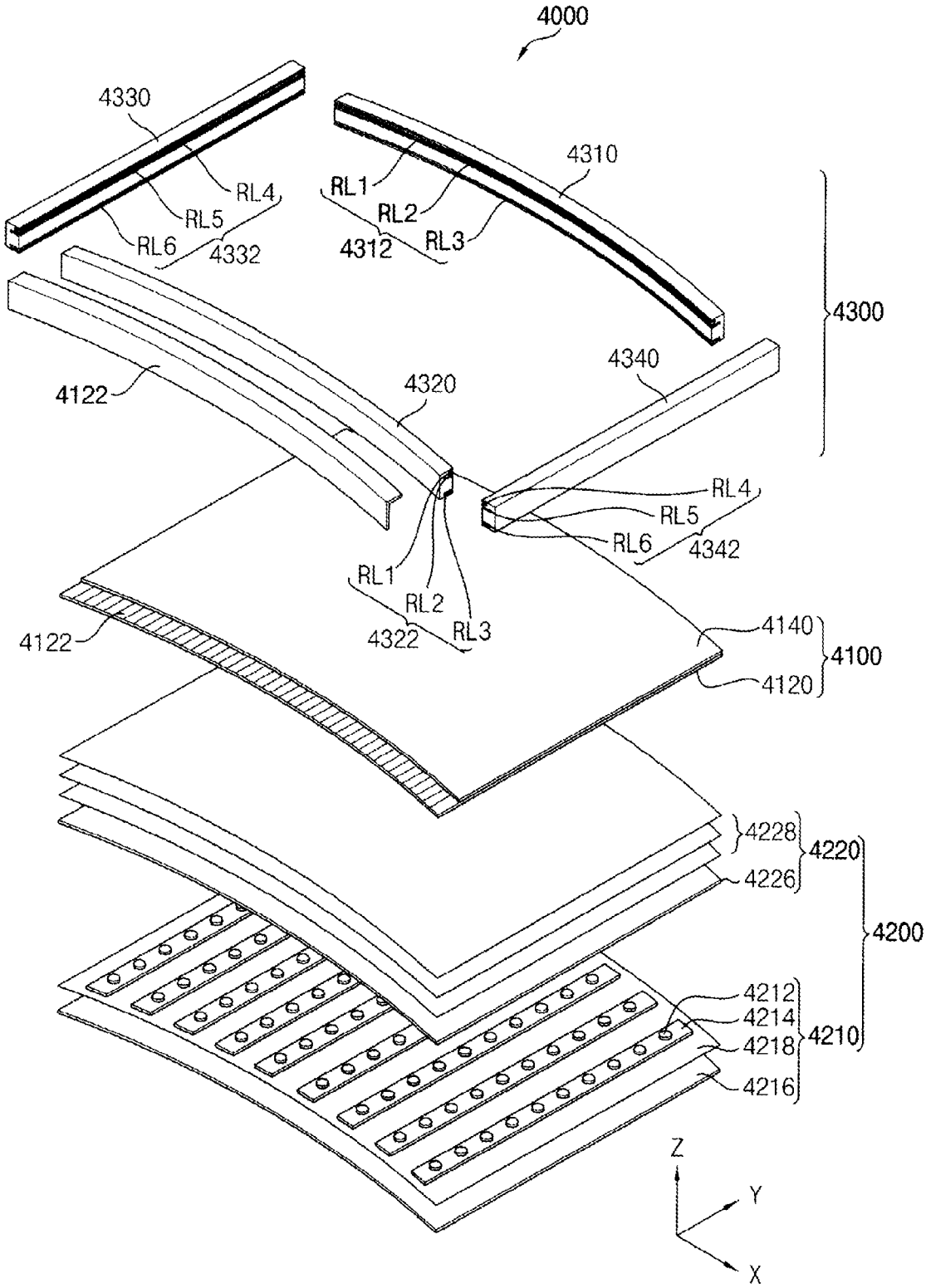
FIG. 16 is a perspective view illustrating a curved display device of FIG. 15.

FIG. 15 is a perspective view schematically illustrating a curved display device 4000 according to still another exemplary embodiment. FIG. 16 is a perspective view illustrating a curved display device 4000 of FIG. 15.

Referring to FIGS. 15 and 16, a curved display device 4000 according to another exemplary embodiment of the present invention includes a display panel 4100, a backlight unit 4200 and a convexly curved frame 4300 to be convexly bent to have a uniform curvature when viewed by a user facing the X-Y plane. A curvature radius corresponding to the curvature may be about 1,000 mm to about 4,000 mm and as shown in FIG. 15 the center point of the curvatures is behind the display panel rather than in front of it.

The display panel 4100 may have a curved shape of a uniform curvature when viewed from an X-Y plan. The display panel 4100 may be a liquid crystal display panel, a plasma display panel, an organic light-emitting display panel, etc. In the present exemplary embodiment, the display panel 4100 may be a liquid crystal display panel including an array substrate 4120, a color filter substrate 4140 facing the array substrate 4120, and a liquid crystal layer (not shown) interposed between the array substrate 4120 and the color filter substrate 4140. A size of the color filter substrate 4140 is substantially smaller than that of the array substrate 4120. Thus, an area not covered by the color filter substrate 4140 is exposed. A pad part 4122 is formed on an exposed area of the array substrate 4120.

The display panel 4100 may be curved before the display panel 4100 is inserted into the curved frame 4300. Alternatively, the display panel 4100 may be curved after the display panel 4100 is inserted into the curved frame 4300. For one example, when the display panel 4100 has a flexible type, the display panel 4100 may be curved after the display panel 4100 is inserted into the curved frame 4300. For another example, when the display panel 4100 has a ridge type, the display panel 41100 may be manufactured to have a curved shape of a predetermined curvature before the display panel 4100 is inserted into the curved frame 4300.

The display panel 4100 may have a curved shape by various manufacturing methods. For example, a flat display panel is disposed between a first curved mold of a convex shape and a second curved mold of a concave shape facing the first curved mold, and then the display panel 4100 may be manufactured through a heat treatment and a pressing treatment. In this case, a bottom surface of an array substrate of the flat display panel is disposed to contact with the first curved mold.

The array substrate 4120 is a substrate on which thin-film transistors (TFTs) that are switching elements are formed in a matrix shape. In the present exemplary embodiment, the array substrate 1120 has a curved shape of uniform curvature. The TFT has a source terminal connected to a data line, a gate terminal connected to a gate line, and a drain terminal connected to a pixel electrode of a transparent conductive material. A data pads part 4122 extended from the display area data lines is disposed on a non-display area of the array substrate 4120. Alternatively, a gate pads part extended from the display area gate lines may be further disposed on the non-display area of the array substrate 4120.

The color filter substrate 4140 is disposed to face the array substrate 4120. The color filter substrate 4140 includes a red pixel, a green pixel and a blue pixel that are formed to realize colors. In the present exemplary embodiment, the color filter substrate 4140 has a curved shape of uniform curvature. A common electrode is formed on the color filter substrate 4140, which is opposite to the pixel electrode of the array substrate 4120. The common electrode includes an optically transparent and electrically conductive material.

Alternatively, the display panel 4100 may include an array substrate on which color filters are formed and an opposition substrate on which a common electrode is formed to face the array substrate.

When a power is applied to a gate terminal of the TFT and the TFT is turned on, an electric field is generated between the pixel electrode and the common electrode. The electric field varies an aligning angle of the liquid crystal molecules interposed between the array substrate 4120 and the color filter substrate 4140. Thus, a light transmittance of the liquid crystal layer is varied in accordance with the variation of the aligning angle of the liquid crystal, so a desired image may be obtained.

The display panel 4100 may include a first polarization film (not shown) disposed below the array substrate 4120 and a second polarization film (not shown) disposed on the color filter substrate 4140. The first polarization film includes a light transmitting axis of a first direction to polarize lights in a first direction. The second polarization film includes a light transmitting axis of a second direction to polarize lights in a second direction. For example, the light transmitting axis of the first polarization film may perpendicular to the light transmitting axis of the second polarization film.

The backlight unit 4200 is disposed at a rear surface of the display panel 4100 to provide lights to the display panel 4100. In the present exemplary embodiment, the backlight unit 4200 has a curved shape which is bent in accordance with a curvature of the display panel 4100. In the present exemplary embodiment, a curvature radius of the backlight unit 1200 may be about 1,000 mm to 4,000 mm. In the present exemplary embodiment, when the display panel 4100 has a curvature radius of one of about 1,000 mm to about 4,000 mm, the backlight unit 4200 may have a curvature radius substantially smaller than a curvature radius of the display panel 4100. For example, when the display panel 4100 has a curvature radius of about 4,000 mm, the backlight unit 4200 may have a curvature radius substantially greater than about 1,000 mm and substantially smaller than about 4,000 mm.

The backlight unit 4200 includes a light source assembly 4210 emitting lights and an optical assembly 4220 enhancing light characteristics emitted from the light source assembly 4210. In the present exemplary embodiment, a curvature radius of the optical assembly 4220 may be substantially smaller than a curvature radius of the display panel 4100, and may be substantially greater than a curvature radius of the light source assembly 4210.

The light source assembly 4210 includes a plurality of light-emitting diode packages 4212 emitting lights and a printed circuit board 4214 on which the light-emitting diode packages 4212 are mounted. A signal wiring (not shown) for providing the light-emitting diode packages 4212 with driving voltages, is formed on the printed circuit board 4214. The light source assembly 4210 may be disposed in correspondence with a direction parallel with a long side of the display panel 4100. Alternatively, the light source assembly 4210 may be disposed in correspondence with a direction parallel with a short side of the display panel 4100.

Moreover, in order to prevent a blue transmittance ratio from being decreased by a buckling phenomenon generated in the display panel 4100, it may vary a disposing or a structure of the light-emitting diode packages 4212. For example, when viewed facing the X-Y plane of the display panel 4100, a light amount of blue, which are emitted from the light-emitting diode packages 4212 disposed on a middle area between a central portion parallel with Y-axis and an edge portion parallel with Y-axis, may be increased. For one example, it may increase the number of blue LEDs rather than the number of red LEDs or the number of green LEDs, thereby increasing a light amount of blue. For another example, it may increase a voltage provided to a blue LED rather than a voltage provided to a red LED or a voltage provided to a green LED, thereby increasing a light amount of blue.

The light source assembly 4210 may further include a bottom plate 4216 and a reflection sheet 4218.

The bottom plate 4216 has a curved shape of a uniform curvature to secure printed circuit boards 4214 having light-emitting diode packages 4212 mounted thereon. In the present exemplary embodiment, the bottom plate 4216 may have a curved shape by various manufacturing methods. For example, a flat bottom plate is disposed between a first curved mold of a concave shape and a second curved mold of a convex shape facing the first curved mold, and then the bottom plate 4216 may be manufactured through a heat treatment and a pressing treatment. In this case, a bottom surface of the flat bottom plate is disposed to contact with the second curved mold.

The reflection sheet 4218 is disposed on the bottom plate 4216 and is disposed below the light source assembly 4210 to reflect lights incident from the light source assembly 4210 toward the diffusion plate 4226.

The optical assembly 4220 may include a diffusion plate 4226 and optical sheets 4228.

The diffusion plate 4226 has a curved shape of uniform curvature. The diffusion plate 4226 diffuses lights emitted from the light source assembly 4210 or lights reflected by the reflection sheet 4218 to provide the optical sheets 4228 with the diffused lights. In the present exemplary embodiment, the diffusion plate 4226 may have a curved shape by various manufacturing methods. For example, a flat diffusion plate is disposed between a first curved mold of a concave shape and a second curved mold of a convex shape facing the first curved mold, and then the diffusion plate 4226 may be manufactured through a heat treatment and a pressing treatment. In this case, a bottom surface of the flat bottom plate is disposed to contact with the second curved mold.

The optical sheets 4228 are disposed on the diffusion plate 4226 to increase efficiency of lights incident from the diffusion plate 4226. The optical sheets 4228 may include a diffusion sheet again diffusing lights diffused by the diffusion plate 4226 and a prism sheet condensing the lights diffused by the diffusion sheet. For one example, the prism sheet may include a vertical prism sheet condensing lights in a vertical direction and a horizontal prism sheet condensing lights in a horizontal direction.

In the present exemplary embodiment, the light source assembly 4220 includes a diffusion plate 4226 and optical sheets 4228 to be guided to the second rail RL2. In this case, the optical sheets 4228 disposed adjacent to the display panel 4100 are exposed in air, thereby generating a sheet wrapping. In order to prevent a sheet wrapping, an additional transparent plate (not shown) may be further disposed. The transparent plate may have a curved shape of a uniform curvature. That is, the optical sheets 4228 are disposed between the transparent plate and the diffusion plate 4226 to prevent a sheet wrapping of the optical sheets 4228.

The curved frame 4300 includes an upper frame part 4310, a lower frame part 4320, a left frame part 4330 and a right frame part 4340 to secure the display panel 4100 and the backlight unit 4200. The curved frame 4300 has a curved shape of uniform curvature.

A first guide rail portion 4312, which is bent to have a first curvature to guide an upper side of the display panel 4100 and an upper side of the backlight unit 4200, is formed through the upper frame part 4310.

A second guide rail portion 4322, which is bent to have the first curvature to guide a lower side of the display panel 4100 and a lower side of the backlight unit 4200, is formed through the lower frame part 4320.

In the present exemplary embodiment, each of the first and second guide rail portions 4312 and 4322 includes a first rail RL1, a second rail RL2 and a third rail RL3. The first rail RL1 is formed adjacent to a front surface of corresponding frame part to guide an upper side of the display panel 4100. The first rail RL1 is bent to correspond to an upper side of the display panel 4100 having a curved shape of a uniform curvature. The second rail RL2 is formed in a rear surface of the first rail RL1 to guide the optical assembly 4220 of the backlight unit 4200. The second rail RL2 is bent to correspond to the optical assembly 4220 having a curved shape of a uniform curvature. The third rail RL3 is formed between a rear surface of the second rail RL2 and a rear surface of corresponding frame part to guide a light source assembly 4210 of the backlight unit 4200. The third rail RL3 is bent to correspond to the light source assembly 4210 having a curved shape of a uniform curvature.

The left frame part 4330 has a straight line shape to be combined with a first end of the upper frame part 4310 and a first end of the lower frame part 4320. The combining may be realized through nuts, bolts, etc. A third guide rail portion 4332 of a straight line shape is formed through the left frame part 4330 so as to guide a left side of the display panel 4100 and a left side of the backlight unit 4200. The third guide rail portion 4332 includes a first rail RL1, a second rail RL3 and a third rail RL3 that are parallel with each other.

The right frame part 4340 has a straight line shape to be combined with a second end of the upper frame part 4310 and a second end of the lower frame part 4320. The combining may be realized through nuts, bolts, etc. A fourth guide rail portion 4342 of a straight line shape is formed through the right frame part 4340 so as to guide a right side of the display panel 4100 and a right side of the backlight unit 4200. The fourth guide rail portion 4342 includes a first rail RL1, a second rail RL3 and a third rail RL3 that are parallel with each other.

Although not shown in FIGS. 15 and 16, the upper, lower, left and right frame parts 4310, 4320, 4330 and 4340 configuring the curved frame 4300 may be configured by an injection formed mold piece and a reinforcing metal chassis, as explained with reference to FIGS. 6 to 9. Thus, it may reduce a manufacturing cost and a weight of a convexly curved display device, and reinforce a strong of a curved display device.

As described above, according to an exemplary embodiment of the present exemplary embodiment, a convexly curved frame having a guide rail portion formed therethrough is configured, so that it may maintain a curvature of a convexly curved frame and curvatures of an optical assembly and a light source assembly of a convexly curved backlight unit. Moreover, a convexly curved display panel and a convexly curved backlight unit may be secured to a convexly curved frame to have a uniform distance.

Accordingly, a convexly curved backlight unit spaced apart from a convexly curved display panel in a uniform distance provides uniform lights to the convexly curved display panel, so that display characteristics of a convexly curved display device may be enhanced. In a convexly curved display device, various elements for providing lights with a convexly curved display panel are disposed in a rear surface of the concavely curved display panel. However, rails are formed through a convexly curved frame, so that a distance between various elements may be uniformly maintained by the rails.

As described above, a curved frame and a curved display device according to the present disclosure of invention may be used in a curved television set, curved personal computers such as notebook PCs, curved office automation equipments, curved audio/video equipments, interior/outdoor advertising curved display devices, and the like.

Moreover, a convexly curved frame having a guide rail portion formed therethrough is employed in a curved display device, so that it may maintain a curvature of a concavely curved display panel and a convexly curved backlight unit. In addition, the convexly curved frame may fix a convexly curved display panel and a convexly curved backlight unit in a uniform interval. Thus, a concavely curved backlight unit spaced apart from a concavely curved display panel in a uniform distance provides uniform lights to the concavely curved display panel, so that display characteristics of a concavely curved display device may be enhanced.

Moreover, a concavely curved frame fixing a concavely curved display panel and a concavely curved backlight unit to have a uniform distance is configured by a mold of an injection molding material and a chassis of a metal material, so that it may reduce a weight and a manufacturing cost of a concavely curved frame.

Moreover, a concavely curved frame having a guide rail portion formed therethrough is employed in a curved display device, so that a concavely curved display panel and a flat backlight unit may be fixed to a concavely curved frame. Accordingly, a screen having glare reducing property may be provided to a viewer viewing images through a concavely curved display device. Moreover, a conventional flat backlight unit may be utilized as a concavely curved display device.

Moreover, a convexly curved frame having a guide rail portion formed therethrough is employed in a curved display device, so that the convexly curved frame may fix a convexly curved display panel and a convexly curved backlight unit in a uniform interval.

Having described exemplary embodiments in accordance with the present disclosure of invention, it is further noted that it is readily apparent to those of reasonable skill in the art in view of the foregoing that various modifications may be made without departing from the spirit and scope of the present teachings.

What is claimed is:

1. A curved frame for securing a display panel and an optionally curved backlight unit disposed behind the display panel, the curved frame comprising:

an upper frame part having a first guide rails portion formed thereon, the first guide rails portion being bent in accordance with a predetermined first set of one or more curvatures to secure and/or guide an upper side of the display panel and an upper side of the optionally curved backlight unit, wherein the upper frame part comprises:

an upper mold having a first groove formed therein at a portion of the upper frame part that is an opposite to where the first guide rails portion is formed; and an upper chassis part disposed in the first groove of the upper mold, the upper chassis part being predominantly composed of a material stronger than a predominant one forming the upper mold so as to thereby reinforce a physical strength attribute of the upper frame part;

a lower frame part having a second guide rails portion formed thereon, the second guide rails portion being bent in accordance with a predetermined second set of one or more curvatures to secure and/or guide a lower side of the display panel and a lower side of the optionally curved backlight unit;

a left frame part combined with a first edge portion of the upper frame part and a first edge portion of the lower frame part; and a right frame part combined with a second edge portion of the upper frame part and a second edge portion of the lower frame part, the second edge portion of the upper and lower frame parts being respectively opposed to the respective first edge portion of the upper and lower frame parts.

2. The curved frame of claim 1, wherein the first guide rails portion comprises one or more curved and spaced apart rails that extend in a substantially parallel relation with a curved front surface provided on the upper frame part.

3. The curved frame of claim 1, wherein the upper frame part and the lower frame part are bent in accordance with substantially same sets of one or more curvatures.

4. The curved frame of claim 1, wherein the upper mold is predominantly composed of an injection molding compatible material, and the upper chassis part is predominantly composed of a stronger metal material.

5. The curved frame of claim 1, wherein a third guide rails portion is formed through the left frame part, and a fourth guide rails portion is formed through the right frame part.

6. A curved frame for securing a display panel and an optionally curved backlight unit disposed behind the display panel, the curved frame comprising:

an upper frame part having a first guide rails portion formed thereon, the first guide rails portion being bent in accordance with a predetermined first set of one or more curvatures to secure and/or guide an upper side of the display panel and an upper side of the optionally curved backlight unit;

a lower frame part having a second guide rails portion formed thereon, the second guide rails portion being bent in accordance with a predetermined second set of one or more curvatures to secure and/or guide a lower side of the display panel and a lower side of the optionally curved backlight unit, wherein the lower frame part comprises:

a lower mold having a second groove formed therein at a portion of the lower frame part that is an opposite to where the second guide rails portion is formed; and a lower chassis part disposed in the second groove of the lower mold to reinforce a strength of the lower mold, the lower chassis part being predominantly composed of a material stronger than a predominant one forming the lower mold so as to thereby reinforce a physical strength attribute of the lower frame part;

a left frame part combined with a first edge portion of the upper frame part and a first edge portion of the lower frame part; and a right frame part combined with a second edge portion of the upper frame part and a second edge portion of the lower frame part, the second edge portion of the upper and lower frame parts being respectively opposed to the respective first edge portion of the upper and lower frame parts.

7. The curved frame of claim 6, wherein the lower mold is predominantly composed of an injection molding compatible material, and the lower chassis part is predominantly composed of a stronger metal material.

8. A curved frame for securing a display panel and an optionally curved backlight unit disposed behind the display panel, the curved frame comprising:

an upper frame part having a first guide rails portion formed thereon, the first guide rails portion being bent in accordance with a predetermined first set of one or more curvatures to secure and/or guide an upper side of the display panel and an upper side of the optionally curved backlight unit;

a lower frame part having a second guide rails portion formed thereon, the second guide rails portion being bent in accordance with a predetermined second set of one or more curvatures to secure and/or guide a lower side of the display panel and a lower side of the optionally curved backlight unit;

a left frame part combined with a first edge portion of the upper frame part and a first edge portion of the lower frame part; and a right frame part combined with a second edge portion of the upper frame part and a second edge portion of the lower frame part, the second edge portion of the upper and lower frame parts being respectively opposed to the respective first edge portion of the upper and lower frame parts; and a coupling part for interconnecting corresponding and adjacent first and second portions of the frame parts, wherein the coupling part comprises:

a nut and a matching bolt, wherein a nut receiving groove for receiving the nut is formed in one of the adjacent first and second portions of the frame parts, and wherein a bolt receiving groove for receiving the bolt is formed in the other of the adjacent first and second portions of the frame parts.

9. The curved frame of claim 8, wherein the nut receiving groove forms a cross shape with the bolt receiving groove.

10. The curved frame of claim 9, wherein the cross shape is configured by a long groove and a short groove, the nut being disposed through the short groove, and the bolt being inserted through a first end of the long groove to penetrate through the nut to extend further towards an opposed second end of the long groove.

11. A curved display device comprising:

a display panel;

a backlight unit disposed behind the display panel, the backlight unit optionally also being curved; and a curved frame for securing the display panel and the optionally curved backlight unit, the curved frame comprising:

an upper frame part having a first guide rails portion formed thereon, the first guide rails portion being bent in accordance with a predetermined first set of one or more curvatures to secure and/or guide an upper side of the display panel and an upper side of the optionally curved backlight unit, wherein the upper frame part comprises:

an upper mold having a first groove formed therein at a portion of the upper frame part that is an opposite to where the first guide rails portion is formed; and an upper chassis part disposed in the first groove of the upper mold, the upper chassis part being predominantly composed of a material stronger than a predominant one forming the upper mold so as to thereby reinforce a physical strength attribute of the upper frame part;

a lower frame part having a second guide rails portion formed thereon, the second guide rails portion being bent in accordance with a predetermined second set of one or more curvatures to secure and/or guide a lower side of the display panel and a lower side of the optionally curved backlight unit;

a left frame part combined with a first edge portion of the upper frame part and a first edge portion of the lower frame part; and a right frame part combined with a second edge portion of the upper frame part and a second edge portion of the lower frame part, the second edge portion of the upper and lower frame parts being respectively opposed to the respective first edge portion of the upper and lower frame parts.

12. The curved display device of claim 11, wherein each of the first and second guide rails portions respectively comprises:

a first rail formed adjacent to a front surface of the corresponding frame part and configured to secure and/or guide a first side of the display panel;

a second rail formed behind the first rail and configured to secure and/or guide a first side of an optical assembly of the backlight unit; and a third rail formed behind the second rail and configured to secure and/or guide a first side of a light source assembly of the backlight unit.

13. The curved display device of claim 11, wherein the backlight unit and the display panel are spaced apart from one another by a uniform interval.

14. The curved display device of claim 11, wherein the backlight unit is flat rather than curved.

15. The curved display device of claim 11, wherein the upper mold is predominantly composed of an injection molding compatible material, and the upper chassis part is predominantly composed of a stronger metal material.

16. The curved display device of claim 11, wherein each of the display panel and the backlight unit has a concave shape, and wherein a curvature radius of the backlight unit is greater than a curvature radius of the display panel.

17. The curved display device of claim 16, wherein the backlight unit comprises a light source assembly configured for emitting lights and an optical assembly configured for enhancing characteristics of lights emitted from the light source assembly, and wherein a curvature radius of the optical assembly is greater than the curvature radius of the display panel, and is smaller than the curvature radius of the light source assembly.

18. The curved display device of claim 11, when each of the display panel and the backlight unit has a convex shape relative to a central viewing spot where a user can view an image produced by the display device, wherein a curvature radius of the backlight unit is smaller than a curvature radius of the display panel and wherein a common point for said curvature radii is located behind the backlight unit.

19. The curved display device of claim 18, wherein the backlight unit comprises a light source assembly configured for emitting lights and an optical assembly configured for enhancing characteristics of lights emitted from the light source assembly, wherein a curvature radius of the optical assembly is smaller than the curvature radius of the display panel, and is greater than the curvature radius of the light source assembly.

20. A curved display device comprising:

a display panel;

a backlight unit disposed behind the display panel, the backlight unit optionally also being curved; and a curved frame for securing the display panel and the optionally curved backlight unit, the curved frame comprising:

an upper frame part having a first guide rails portion formed thereon, the first guide rails portion being bent in accordance with a predetermined first set of one or more curvatures to secure and/or guide an upper side of the display panel and an upper side of the optionally curved backlight unit;

a lower frame part having a second guide rails portion formed thereon, the second guide rails portion being bent in accordance with a predetermined second set of one or more curvatures to secure and/or guide a lower side of the display panel and a lower side of the optionally curved backlight unit, wherein the lower frame part comprises:

a lower mold having a second groove formed therein at a portion of the lower frame part that is an opposite to where the second guide rails portion is formed; and a lower chassis part disposed in the second groove of the lower mold to reinforce a strength of the lower mold, the lower chassis part being predominantly composed of a material stronger than a predominant one forming the lower mold so as to thereby reinforce a physical strength attribute of the lower frame part;

a left frame part combined with a first edge portion of the upper frame part and a first edge portion of the lower frame part; and a right frame part combined with a second edge portion of the upper frame part and a second edge portion of the lower frame part, the second edge portion of the upper and lower frame parts being respectively opposed to the respective first edge portion of the upper and lower frame parts.

21. The curved display device of claim 20, wherein the lower mold is predominantly composed of an injection molding compatible material, and the lower chassis part is predominantly composed of a stronger metal material.

22. A curved display device comprising:

a display panel;

a backlight unit disposed behind the display panel, the backlight unit optionally also being curved, wherein the backlight unit comprises a plurality of red light-emitting diodes, a plurality of green light-emitting diodes and a plurality of blue light-emitting diodes, and wherein a number of blue light-emitting diodes disposed per unit of display area and in a middle portion of the display area, between a central portion of the display area and an extreme left or right edge portion of the display area is greater than a corresponding number of red light-emitting diodes or a corresponding number of green light-emitting diodes that are disposed in that middle portion of the display area; and a curved frame for securing the display panel and the optionally curved backlight unit, the curved frame comprising:

an upper frame part having a first guide rails portion formed thereon, the first guide rails portion being bent in accordance with a predetermined first set of one or more curvatures to secure and/or guide an upper side of the display panel and an upper side of the optionally curved backlight unit;

a lower frame part having a second guide rails portion formed thereon, the second guide rails portion being bent in accordance with a predetermined second set of one or more curvatures to secure and/or guide a lower side of the display panel and a lower side of the optionally curved backlight unit;

a left frame part combined with a first edge portion of the upper frame part and a first edge portion of the lower frame part; and a right frame part combined with a second edge portion of the upper frame part and a second edge portion of the lower frame part, the second edge portion of the upper and lower frame parts being respectively opposed to the respective first edge portion of the upper and lower frame parts.

23. A curved display device comprising:

a display panel;

a backlight unit disposed behind the display panel, the backlight unit optionally also being curved, wherein the backlight unit comprises a plurality of red light-emitting diodes, a plurality of green light-emitting diodes and a plurality of blue light-emitting diodes, and wherein an average drive power applied to blue light-emitting diodes disposed in a middle area between a central portion of the display panel and an extreme left or right edge portion is greater than a corresponding average power applied to red light-emitting diodes or the number of green light-emitting diodes that are disposed in the middle area; and a curved frame for securing the display panel and the optionally curved backlight unit, the curved frame comprising:

an upper frame part having a first guide rails portion formed thereon, the first guide rails portion being bent in accordance with a predetermined first set of one or more curvatures to secure and/or guide an upper side of the display panel and an upper side of the optionally curved backlight unit;

a lower frame part having a second guide rails portion formed thereon, the second guide rails portion being bent in accordance with a predetermined second set of one or more curvatures to secure and/or guide a lower side of the display panel and a lower side of the optionally curved backlight unit;

a left frame part combined with a first edge portion of the upper frame part and a first edge portion of the lower frame part; and a right frame part combined with a second edge portion of the upper frame part and a second edge portion of the lower frame part, the second edge portion of the upper and lower frame parts being respectively opposed to the respective first edge portion of the upper and lower frame parts.

* * * * *